US008654054B2

(12) United States Patent
Lee

(10) Patent No.: US 8,654,054 B2
(45) Date of Patent: Feb. 18, 2014

(54) LIQUID CRYSTAL DISPLAY DEVICE AND DRIVING METHOD THEREOF

(75) Inventor: Ju Young Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1139 days.

(21) Appl. No.: 12/314,559

(22) Filed: Dec. 12, 2008

(65) Prior Publication Data

US 2009/0160749 A1 Jun. 25, 2009

(30) Foreign Application Priority Data

Dec. 21, 2007 (KR) ..... 10-2007-0135045

(51) Int. Cl.
*G09G 3/36* (2006.01)
*G09G 3/04* (2006.01)

(52) U.S. Cl.
USPC ..... 345/95; 345/33; 345/92

(58) Field of Classification Search
USPC ..... 345/95
See application file for complete search history.

(56) References Cited

U.S. PATENT DOCUMENTS

| | | | | |
|---|---|---|---|---|
| 6,707,441 | B1 * | 3/2004 | Hebiguchi et al. | 345/92 |
| 8,068,085 | B2 * | 11/2011 | Yamazaki | 345/100 |
| 2002/0186193 | A1 * | 12/2002 | Lee et al. | 345/96 |
| 2003/0090448 | A1 * | 5/2003 | Tsumura et al. | 345/87 |
| 2004/0080679 | A1 * | 4/2004 | Song et al. | 349/43 |
| 2005/0078069 | A1 * | 4/2005 | Aiba et al. | 345/87 |
| 2006/0192744 | A1 * | 8/2006 | Yamazaki | 345/100 |
| 2007/0057888 | A1 * | 3/2007 | Lin et al. | 345/92 |

* cited by examiner

*Primary Examiner* — Alexander S Beck
*Assistant Examiner* — Mihir Rayan
(74) *Attorney, Agent, or Firm* — Morgan, Lewis & Bockius LLP

(57) ABSTRACT

Disclosed herein are a liquid crystal display device which is capable of driving a liquid crystal using image signals supplied to two adjacent data lines, and a driving method thereof. The liquid crystal display device has a plurality of liquid crystal cells formed respectively in pixel areas defined by intersections of n gate lines and m data lines. Each of the liquid crystal cells includes a thin film transistor connected to any one of the gate lines and any one of two data lines adjacent respectively to left and right sides of a corresponding one of the liquid crystal cells, among the data lines, and a liquid crystal capacitor and a storage capacitor each formed between the other one of the two adjacent data lines and the thin film transistor.

26 Claims, 17 Drawing Sheets

LIQUID CRYSTAL DISPLAY DEVICE AND DRIVING METHOD THEREOF

This application claims the benefit of Korean Patent Application No. P2007-135045, filed on Dec. 21, 2007, which is hereby incorporated by reference as if fully set forth herein.

BACKGROUND OF THE INVENTION

1. Field of the Invention

The present invention relates to a liquid crystal display device, and more particularly, to a liquid crystal display device which is capable of driving a liquid crystal using image signals supplied to two adjacent data lines, and a driving method thereof.

2. Discussion of the Related Art

Generally, a conventional liquid crystal display device is adapted to display an image by adjusting light transmittance of a liquid crystal using an electric field. To this end, the liquid crystal display device comprises a liquid crystal panel including liquid crystal cells arranged in matrix form between two glass substrates and each having a liquid crystal formed between the glass substrates and switching elements for switching signals to be supplied to the liquid crystal cells, respectively, a driving circuit for driving the liquid crystal panel, and a backlight unit for irradiating light to the liquid crystal panel.

Each of the liquid crystal cells of the liquid crystal panel adjusts light transmittance of the liquid crystal based on an electric field formed by a potential difference between an image signal supplied to a corresponding data line and a common voltage applied to an opposite electrode.

However, the conventional liquid crystal display device has problems as follows.

Firstly, a common voltage supply line is required to apply the common voltage to the opposite electrode of each liquid crystal cell, resulting in a reduction in aperture ratio of each liquid crystal cell.

Secondly, because a flicker occurs due to a kickback voltage $\Delta Vp$ resulting from a parasitic capacitance of each liquid crystal cell, the common voltage must be adjusted to remove the flicker.

Thirdly, a picture quality is degraded due to a horizontal crosstalk resulting from a distortion of the common voltage based on the position of each liquid crystal cell.

Fourthly, a voltage of a direct current (DC) offset component is applied to the liquid crystal due to the kickback voltage, resulting in a deterioration of the liquid crystal.

Fifthly, an afterimage is generated due to a polarity inversion of each liquid crystal cell based on an inversion scheme. That is, in order to reduce the DC offset component and, in turn, the deterioration of the liquid crystal, the conventional liquid crystal display device is driven in the inversion scheme where the polarity is inverted between adjacent liquid crystal cells and on a frame period basis. However, when any one of two polarities of a data voltage is dominantly supplied for a lengthy period of time, an afterimage in which the pattern of the original image appears faintly is generated. This afterimage is called "DC image sticking' in that a voltage of the same polarity is repetitively charged in the liquid crystal cell.

Sixthly, because the voltage level of an image signal is divided into a positive polarity and a negative polarity on the basis of the common voltage, the image signal has a large swing width based on the polarities, thereby increasing the amount of heat to be generated in a data driving circuit and the amount of current to be consumed therein.

SUMMARY OF THE INVENTION

Accordingly, the present invention is directed to a liquid crystal display device and a driving method thereof that substantially obviate one or more problems due to limitations and disadvantages of the related art.

An object of the present invention is to provide a liquid crystal display device which is capable of driving a liquid crystal using image signals supplied to two adjacent data lines, and a driving method thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device has a plurality of liquid crystal cells formed respectively in pixel areas defined by intersections of n gate lines and m data lines, wherein each of the liquid crystal cells comprises: a thin film transistor connected to any one of the gate lines and any one of two data lines adjacent respectively to left and right sides of a corresponding one of the liquid crystal cells, among the data lines; and a liquid crystal capacitor and a storage capacitor each formed between the other one of the two adjacent data lines and the thin film transistor.

In another aspect of the present invention, a liquid crystal display device comprises: an image display panel including a plurality of liquid crystal cells formed respectively in pixel areas defined by intersections of n gate lines and m data lines; a gate driving circuit for driving the gate lines; a data driving circuit for converting the same data into first and second image signals, the first and second image signals having voltage levels symmetrical about a middle voltage between a lowest voltage and a highest voltage, and supplying the converted first and second image signals respectively to two data lines adjacent respectively to left and right sides of each of the liquid crystal cells, among the data lines; and a timing controller for controlling the gate driving circuit and the data driving circuit and supplying the data corresponding to the first and second image signals to the data driving circuit, wherein the liquid crystal cells are arranged on a plurality of horizontal lines corresponding respectively to the gate lines, wherein all the liquid crystal cells on each of the horizontal lines are simultaneously driven by the driving of a corresponding one of the gate lines.

In a further aspect of the present invention, a method for driving a liquid crystal display device, where the liquid crystal display device having a plurality of liquid crystal cells formed respectively in pixel areas defined by intersections of n gate lines and m data lines, comprises: sequentially driving the gate lines; converting the same data into first and second image signals, the first and second image signals being symmetrical about a middle voltage between a lowest voltage and a highest voltage; supplying the first and second image signals to each of the liquid crystal cells, respectively, through two data lines adjacent respectively to left and right sides thereof, among the data lines, synchronously with the driving of a corresponding one of the gate lines; and simultaneously driving all the liquid crystal cells arranged on each of horizontal lines corresponding respectively to the gate lines using the first and second image signals supplied to each of the liquid crystal cells.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts. In the following description of the present invention, a detailed description of known functions and configurations incorporated herein will be omitted when it may make the subject matter of the invention rather unclear.

Figure 1:
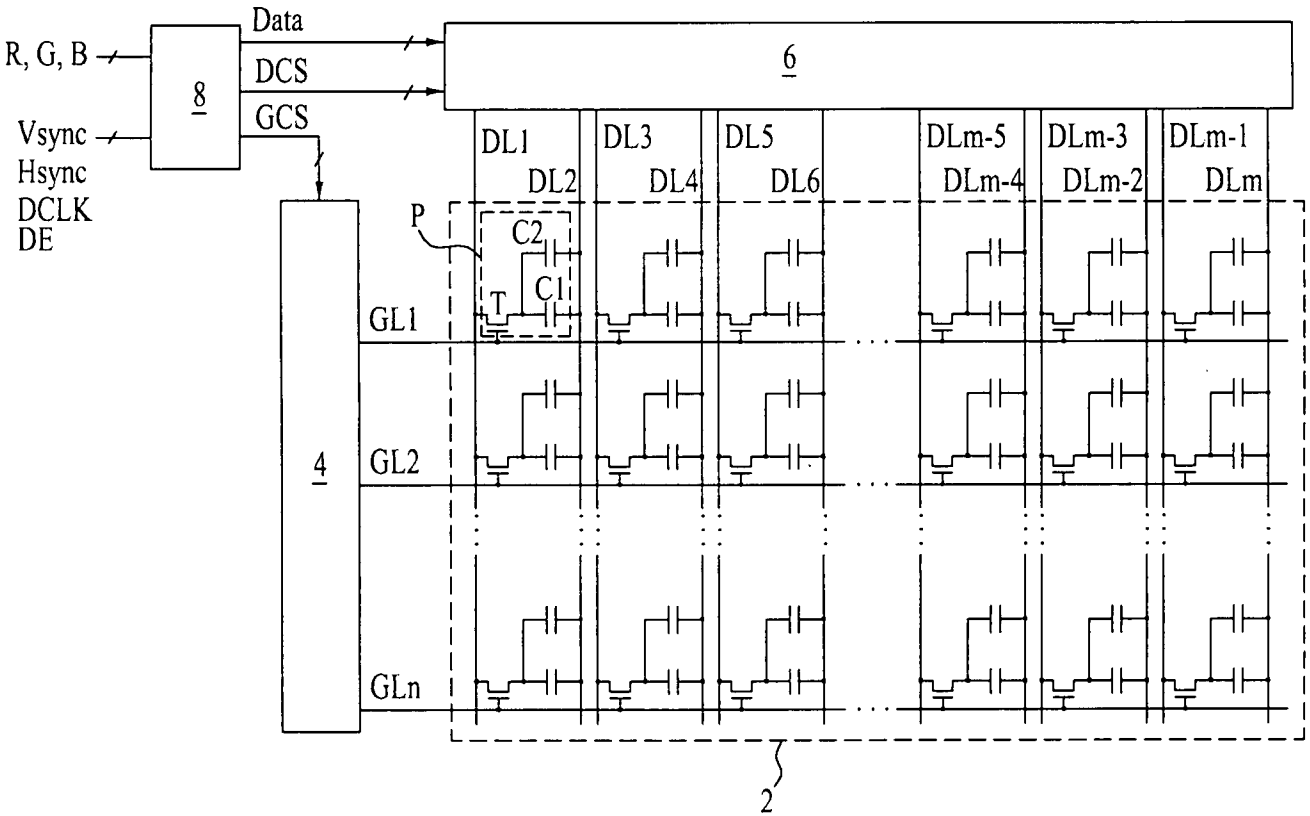
FIG. 1 is a schematic view of a liquid crystal display device according to a first embodiment of the present invention.
Figure 2:
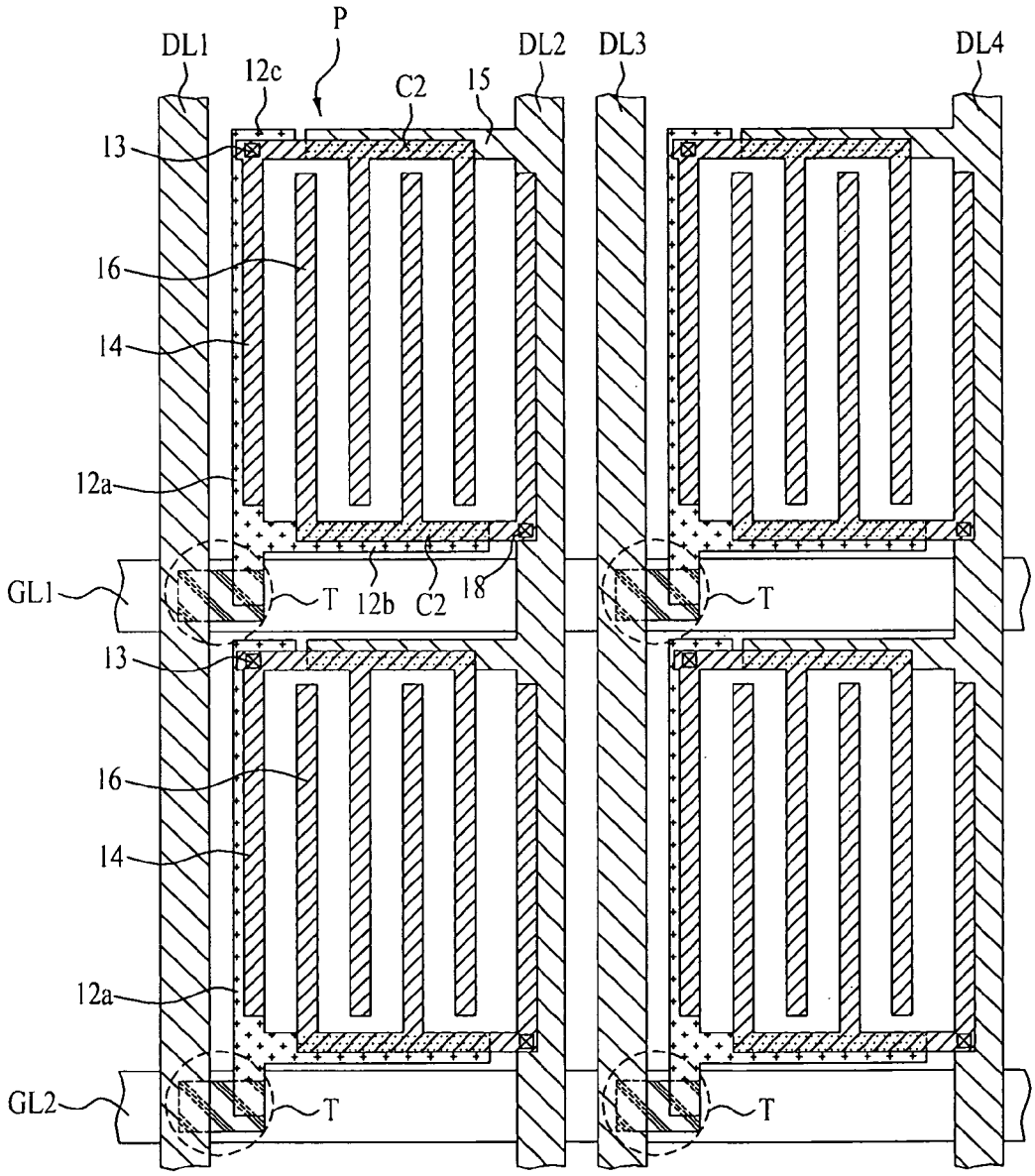
FIG. 2 is a plan view showing a layout of liquid crystal cells formed in an image display panel shown in FIG. 1.

FIG. 1 is a schematic view of a liquid crystal display device according to a first embodiment of the present invention, and FIG. 2 is a plan view showing a layout of liquid crystal cells formed in an image display panel shown in FIG. 1.

Referring to FIGS. 1 and 2, the liquid crystal display device according to the first embodiment of the present invention comprises an image display panel 2 including a plurality of liquid crystal cells P formed respectively in pixel areas defined by m data lines DL1 to DLm and n gate lines GL1 to GLn and each adapted for driving a liquid crystal based on image signals supplied to two data lines adjacent respectively to the left and right sides thereof, among the data lines DL1 to DLm, a gate driving circuit 4 for driving the gate lines GL1 to GLn, a data driving circuit 6 for supplying an image signal to each of the data lines DL1 to DLm, and a timing controller 8 for supplying a data signal to the data driving circuit 6 and controlling the gate and data driving circuits 4 and 6.

Each liquid crystal cell P includes a thin film transistor T connected to any one of the n gate lines GL1 to GLn and any one of the m data lines DL1 to DLm, and a liquid crystal capacitor C1 and a storage capacitor C2 each formed between the thin film transistor T and a data line DL adjacent thereto, among the data lines DL1 to DLm. Three liquid crystal cells adjacent along each gate line GL, namely, red, green and blue liquid crystal cells constitute one unit pixel.

In detail, each liquid crystal cell P includes a thin film transistor T including a semiconductor layer overlapping a corresponding one of the n gate lines GL1 to GLn and having one side formed to partially overlap a corresponding one of the odd data lines DL1, DL3, DL5, . . . , DLm−1, and a drain electrode formed to overlap the other side of the semiconductor layer, a pixel electrode 14 connected to the drain electrode via a first contact hole 13, an opposite electrode 16 connected to an adjacent one of the even data lines DL2, DL4, DL6, . . . , DLm via a second contact hole 18 and formed to partially overlap the pixel electrode 14, and a protrusion electrode 15 protruded from the adjacent even data line DL2, DL4, DL6, . . . , or DLm to partially overlap the pixel electrode 14.

The corresponding odd data line DL1, DL3, DL5, or DLm−1 overlapped by the one side of the semiconductor layer acts as a source electrode of the thin film transistor T.

The drain electrode of the thin film transistor T includes a vertical portion 12*a* formed to overlap the other side of the semiconductor layer and arranged in parallel with the corresponding odd data line DL1, DL3, DL5, . . . , or DLm−1 while being spaced apart from the corresponding odd data line DL1, DL3, DL5, . . . , or DLm−1 by a predetermined distance, a first horizontal portion 12*b* protruded from the bottom of the vertical portion 12*a* and arranged in parallel with the corresponding gate line GL while being spaced apart from the corresponding gate line GL by a predetermined distance, and a second horizontal portion 12*c* protruded from the top of the vertical portion 12*a* and arranged in parallel with the first horizontal portion 12*b*. Here, the first horizontal portion 12*b* is protruded longer than the second horizontal portion 12*c* such that it is adjacent to the adjacent even data line DL2, DL4, DL6, . . . , or DLm, and the second horizontal portion 12*c* is protruded shorter than the first horizontal portion 12*b* such that it is adjacent to the protrusion electrode 15. Alternatively, the second horizontal portion 12*c* may not be formed.

The pixel electrode 14 is electrically connected to the drain electrode via the first contact hole 13, which is formed in a bent portion between the ('제 1' 삭제) vertical portion 12*a* of the drain electrode and the second horizontal portion 12*c* of the drain electrode. The pixel electrode 14 includes a first body overlapping the second horizontal portion 12*c* of the drain electrode and the protrusion electrode 15 via a protection film (not shown), and a plurality of first wings protruded from the first body by a predetermined distance from the first body. Here, the plurality of first wings are arranged in parallel at regular intervals and each have at least one of a bent shape, curved shape and straight line shape. Any one of the plurality of first wings may overlap the vertical portion 12*a* of the drain electrode.

The opposite electrode 16 is electrically connected to the adjacent even data line DL2, DL4, DL6, . . . , or DLm via the second contact hole 18. The opposite electrode 16 includes a second body overlapping the first horizontal portion 12*b* of the drain electrode via a protection film, and a plurality of second wings protruded from the second body toward the first body of the pixel electrode 14. Here, each of the plurality of second wings has the same shape as that of each of the plurality of first wings and is disposed between adjacent ones of the plurality of first wings. Any one of the plurality of second wings may overlap the adjacent even data line DL2, DL4, DL6, . . . , or DLm.

The liquid crystal capacitor C1 is formed by a liquid crystal layer between the pixel electrode 14 and the opposite electrode 16.

The storage capacitor C2 includes a first storage capacitor formed by an overlap of the first horizontal portion 12*b* of the drain electrode and the second body of the opposite electrode 16, and a second storage capacitor formed by an overlap of the first body of the pixel electrode 14 and the protrusion electrode 15.

The liquid crystal capacitor C1 of each liquid crystal cell P drives a liquid crystal by forming a horizontal electric field based on a potential difference between a first image signal which is supplied from a corresponding one of the odd data lines DL1, DL3, DL5, . . . , DLm−1 to the pixel electrode 14 and a second image signal which is supplied from a corresponding one of the even data lines DL2, DL4, DL6, . . . , DLm to the opposite electrode 16. At this time, the second image signal which is supplied from the corresponding even data line DL2, DL4, DL6, . . . , or DLm to the opposite electrode 16 is a reference voltage to drive the corresponding liquid crystal cell P.

The storage capacitor C2 of each liquid crystal cell P stores the potential difference between the first image signal and the second image signal when the corresponding liquid crystal cell P is driven, so as to maintain a voltage stored in the liquid crystal capacitor C1 of the liquid crystal cell P after the thin film transistor T is turned off.

Figure 3:
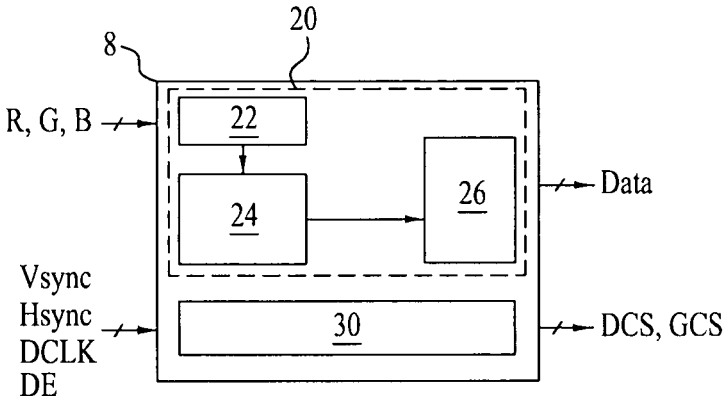
FIG. 3 is a schematic block diagram of a timing controller shown in FIG. 1.

The timing controller 8 includes, as shown in FIG. 3, a data arranger 20 for arranging input data signals R, G and B and supplying the arranged data signals to the data driving circuit 6, and a control signal generator 30 for generating gate and data control signals GCS and DCS using synchronous signals.

The control signal generator 30 generates the gate control signal GCS for supply of a gate pulse to each gate line GL of the image display panel 2 using at least one of a dot clock DCLK, a data enable signal DE and vertical and horizontal synchronous signals Vsync and Hsync from the outside. Here, the gate control signal GCS includes a gate start pulse GSP, gate shift clock GSC and gate output enable signal GOE to control a driving timing of the gate driving circuit 4.

Also, the control signal generator 30 generates the data control signal DCS for supply of an image signal to each data line DL of the image display panel 2 using at least one of the dot clock DCLK, the data enable signal DE and the vertical and horizontal synchronous signals Vsync and Hsync from the outside. Here, the data control signal DCS includes a source output enable signal SOE, source shift clock SSC, source start pulse SSP and polarity control signal POL to control a driving timing of the data driving circuit 6.

The data arranger 20 includes a data storage unit 22, double data generator 24, and data output unit 26.

Figure 4A:
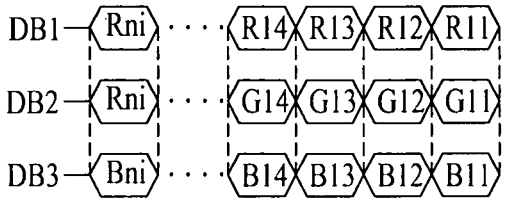
FIG. 4A is a view illustrating data signals supplied to a data arranger shown in FIG. 3.

The data storage unit 22 stores data R11, G11, B11, . . . , Rni, Gni and Bni of one horizontal line inputted over three data bus lines DB1, DB2 and DB3, as shown in FIG. 4A. Here, i is a natural number which is m/2.

The double data generator 24 doubles each of the data R11, G11, B11, . . . , Rni, Gni and Bni supplied from the data storage unit 22 into two data of the original gray scale and supplies the two data to the data output unit 26. For example, in order to supply the first and second image signals to the first red liquid crystal cell of the first horizontal line, the double data generator 24 doubly outputs one first red data R11 to the data output unit 26, or copies it to generate two red data R11 and R11 and supplies the generated two red data R11 and R11 to the data output unit 26. For the double output, the double data generator 24 outputs the first red data R11 to the data output unit 26 twice using two different clock signals.

The data output unit 26 arranges the data supplied from the double data generator 24 suitably to an array structure of the liquid crystal cells in the image display panel 2 using the dot clock DCLK or a clock internally generated by the timing controller 8 such that the supplied data corresponds to the number of data bus lines between the timing controller 8 and the data driving circuit 6, and supplies the arranged data to the data driving circuit 6.

In detail, the data output unit 26 outputs data to be supplied to each liquid crystal cell to both two data bus lines. At this time, the data outputted to any one of the two data bus lines is data for generation of the first image signal, and the data outputted to the other data bus line is data for generation of the second image signal. For example, in the first liquid crystal cell of the red color connected to the first and second data lines and the first gate line, the data output unit 26 outputs the red data R11 to be supplied to the first liquid crystal cell of the red color to both first and second data bus lines. Consequently, the data output unit 26 arranges data Data as shown in FIG. 4B such that the data Data corresponds to arranged positions of the liquid crystal cells P, and outputs the arranged data Data to six data bus lines DB1 to DB6.

In FIG. 1, the gate driving circuit 4 generates a gate pulse in response to the gate control signal GCS supplied from the timing controller 8 and supplies the generated gate pulse sequentially to the gate lines GL. As a result, the gate lines GL of the image display panel 2 are sequentially driven by the gate pulse from the gate driving circuit 4. On the other hand, the gate driving circuit 4 may be formed on a substrate on which the image display panel 2 is formed and be connected to the gate lines GL, at the same time that a manufacturing process of the thin film transistor is performed.

This gate driving circuit 4 is disposed at one side of the image display panel 2 and connected to one ends of the gate lines GL, as shown in FIG. 1.

Figure 4B:
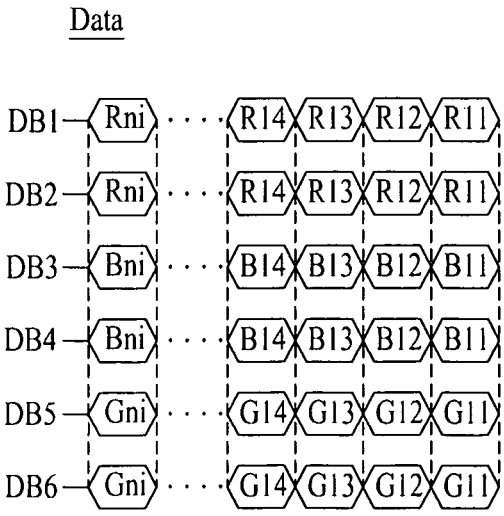
FIG. 4B is a view illustrating data outputted from a data output unit shown in FIG. 3.

The data driving circuit 6 samples data Data of one horizontal line, supplied from the timing controller 8 over the data bus lines as shown in FIG. 4B, using the data control signal DCS supplied from the timing controller 8, converts the sampled data into positive image signals or negative image signals using a plurality of gamma voltages and the polarity control signal and supplies the converted positive or negative image signals to the data lines.

Here, the plurality of gamma voltages include a plurality of positive (+) gamma voltages and a plurality of negative (−) gamma voltages which are symmetrical about a middle voltage between a lowest voltage and a highest voltage. For example, in the case where the lowest voltage is 0V and the highest voltage is 8V, the plurality of positive (+) gamma voltages have different voltage levels within the range of more than 4V which is the middle voltage, but not more than 8V, and the plurality of negative (−) gamma voltages have different voltage levels within the range from 0V to less than 4V. Here, 0V may be a negative white voltage and 8V may be a positive white voltage. As a result, sampled data is converted into a positive first image signal or negative first image signal or converted into a positive second image signal or negative second image signal.

Because the first and second image signals which are supplied to each liquid crystal cell P are symmetrical about the middle voltage as stated above, the liquid crystal of each liquid crystal cell P can be driven with a high voltage. For example, for display of a positive white image on a liquid crystal cell, conventionally, a common voltage of 4V is supplied to an opposite electrode through a common voltage supply line and a positive data voltage of 8V is applied to a pixel electrode through a data line, so that the positive white image is displayed using a potential difference of 4V. In contrast, in the present invention, a positive first image signal of 8V is supplied to a pixel electrode through a first data line and a negative second image signal of 0V is supplied to an opposite electrode through a second data line, so that the positive white image is displayed using a potential difference of 8V. Consequently, according to the present invention, the positive white image is displayed using the potential difference of 8V, thereby making it possible to drive the liquid crystal with a high voltage compared with a conventional one, so as to increase a response speed of the liquid crystal. In addition, in the case where the liquid crystal driving voltage of the present invention is made to be equal to a conventional one, the present invention can reduce power consumption.

Figure 5A:
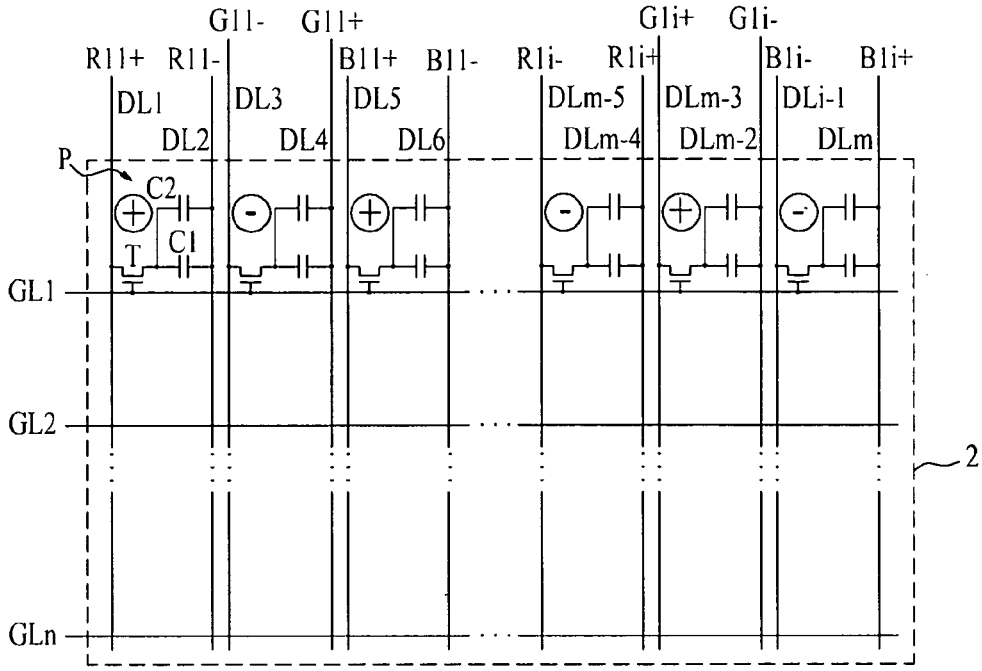
FIGS. 5A and 5B are views stepwise illustrating a driving method of the liquid crystal display device according to the first embodiment of the present invention.
Figure 5B:
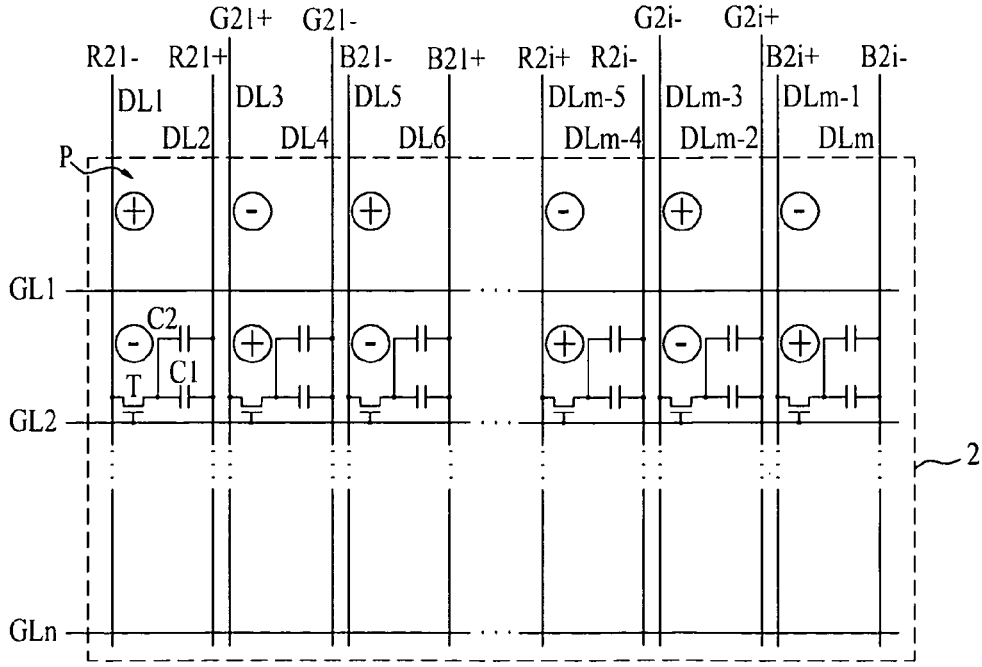

FIGS. 5A and 5B are views stepwise illustrating the polarities of image signals supplied to the image display panel and the polarities of the liquid crystal cells of the image display panel, in a driving method of the liquid crystal display device according to the first embodiment of the present invention. FIGS. 5A and 5B show only liquid crystal cells to which image signals are supplied.

First, the gate pulse is supplied to the first gate line GL1 by the gate driving circuit 4. In synchronization with this, the data driving circuit 6 supplies first image signals R11+, G11−, B11+, . . . , B1*i*− respectively to the odd data lines DL1, DL3, DL5, . . . , DLm−1 and supplies second image signals R11−, G11+, B11−, . . . , B1*i*+ respectively to the even data lines DL2, DL4, DL6, . . . , DLm, as shown in FIG. 5A. At this time, assuming that the two data lines adjacent respectively to the left and right sides of each liquid crystal cell constitute one data line group, the polarities of the image signals are inverted for every data line group. That is, the positive (+) first image signals R11+, B11+, . . . , G1*i*+ are supplied respectively to the odd data lines DL1, DL5, DL9, . . . , DLm−3 connected respectively to odd ones of the liquid crystal cells P of the first horizontal line and, at the same time, the negative (−) second image signals R11−, B11−, . . . , G1*i*− are supplied respectively to the even data lines DL2, DL6, DL10, . . . , DLm−2 connected respectively to the odd liquid crystal cells. Also, the negative (−) first image signals G11−, . . . , Rli− and B1*i*− are supplied respectively to the odd data lines DL3, DL7, DL11, . . . , DLm−1 connected respectively to even ones of the liquid crystal cells P of the first horizontal line and, at the same time, the positive (+) second image signals G11+, . . . , R1*i*+ and B1*i*+ are supplied respectively to the even data lines DL4, DL8, DL12, . . . , DLm connected respectively to the even liquid crystal cells.

As a result, each odd one of the liquid crystal cells P of the first horizontal line displays an image by driving the liquid crystal with a positive electric field based on a potential difference of the positive first image signal supplied to the pixel electrode 14 from the negative second image signal supplied to the opposite electrode 16. Hereinafter, the image displayed by the positive electric field will be referred to as a "positive image". For example, in the case where a positive first image signal of 8V is supplied to the first data line DL1 and, at the same time, a negative second image signal of 0V is supplied to the second data line DL2, the first liquid crystal cell forms a positive electric field to display a positive image (+), because the data voltage of 8V is higher than the reference voltage of 0V.

Also, each even one of the liquid crystal cells P of the first horizontal line displays an image by driving the liquid crystal with a negative electric field based on a potential difference of the negative first image signal supplied to the pixel electrode 14 from the positive second image signal supplied to the opposite electrode 16. Hereinafter, the image displayed by the negative electric field will be referred to as a "negative image". For example, in the case where a negative first image signal of 0V is supplied to the third data line DL3 and, at the same time, a positive second image signal of 8V is supplied to the fourth data line DL4, the second liquid crystal cell forms a negative electric field to display a negative image (−), because the data voltage of 0V is lower than the reference voltage of 8V.

Consequently, the polarities of images which are displayed on the liquid crystal cells P of the first horizontal line are inverted for every liquid crystal cell.

Thereafter, the gate pulse is supplied to the second gate line GL2 by the gate driving circuit 4. In synchronization with this, the data driving circuit 6 supplies first image signals R21−, G21+, B21−, . . . , B21+ respectively to the odd data lines DL1, DL3, DL5, . . . , DLm−1 and supplies second image signals R21+, G21−, B21+, . . . , B2*i*− respectively to the even data lines DL2, DL4, DL6, . . . , DLm, as shown in FIG. 5B. At this time, the negative (−) first image signals R21−, B21−, . . . , G2*i*− are supplied respectively to the odd data lines DL1, DL5, DL9, . . . , DLm−3 connected respectively to odd ones of the liquid crystal cells P of the second horizontal line and, at the same time, the positive (+) second image signals R21+, B21+, . . . , G2*i*+ are supplied respectively to the even data lines DL2, DL6, DL10, . . . , DLm−2 connected respectively to the odd liquid crystal cells. Also, the positive (+) first image signals G21+, . . . , R2*i*+ and B2*i*+ are supplied respectively to the odd data lines DL3, DL7, DL11, . . . , DLm−1 connected respectively to even ones of the liquid crystal cells P of the second horizontal line and, at the same time, the negative (−) second image signals G21−, . . . , R2*i*− and B2*i*− are supplied respectively to the even data lines DL4, DL8, DL12, . . . , DLm connected respectively to the even liquid crystal cells.

As a result, each odd one of the liquid crystal cells P of the second horizontal line displays a negative image by driving the liquid crystal with a negative electric field based on a potential difference of the negative first image signal supplied to the pixel electrode 14 from the positive second image signal supplied to the opposite electrode 16.

Also, each even one of the liquid crystal cells P of the second horizontal line displays a positive image by driving the liquid crystal with a positive electric field based on a potential difference of the positive first image signal supplied to the pixel electrode 14 from the negative second image signal supplied to the opposite electrode 16.

Consequently, the polarities of images which are displayed on the liquid crystal cells P of the second horizontal line are inverted for every liquid crystal cell and become inverted ones of the polarities of images which are displayed on the liquid crystal cells P of the first horizontal line.

The liquid crystal cells of the remaining third to nth horizontal lines corresponding respectively to the third to nth gate lines GL3 to GLn display images in the same manner as those of the first and second horizontal lines described above. Therefore, displayed on the image display panel is an image having a polarity pattern of a 1-dot inversion scheme where image signals are inverted in polarity on a liquid crystal cell basis.

On the other hand, although the polarity pattern of the image displayed on the image display panel has been described to be based on the 1-dot inversion scheme, the present invention is not limited thereto. For example, the polarity pattern of the displayed image may be set based on the polarity control signal of the data control signal.

As described above, in the liquid crystal display device and the driving method thereof according to the first embodiment of the present invention, first and second image signals having voltage levels symmetrical about a middle voltage are supplied to each liquid crystal cell through two data lines adjacent respectively to the left and right sides thereof to drive a liquid crystal. Therefore, it is possible to display an image with only a data voltage without using a common voltage.

Figure 6:
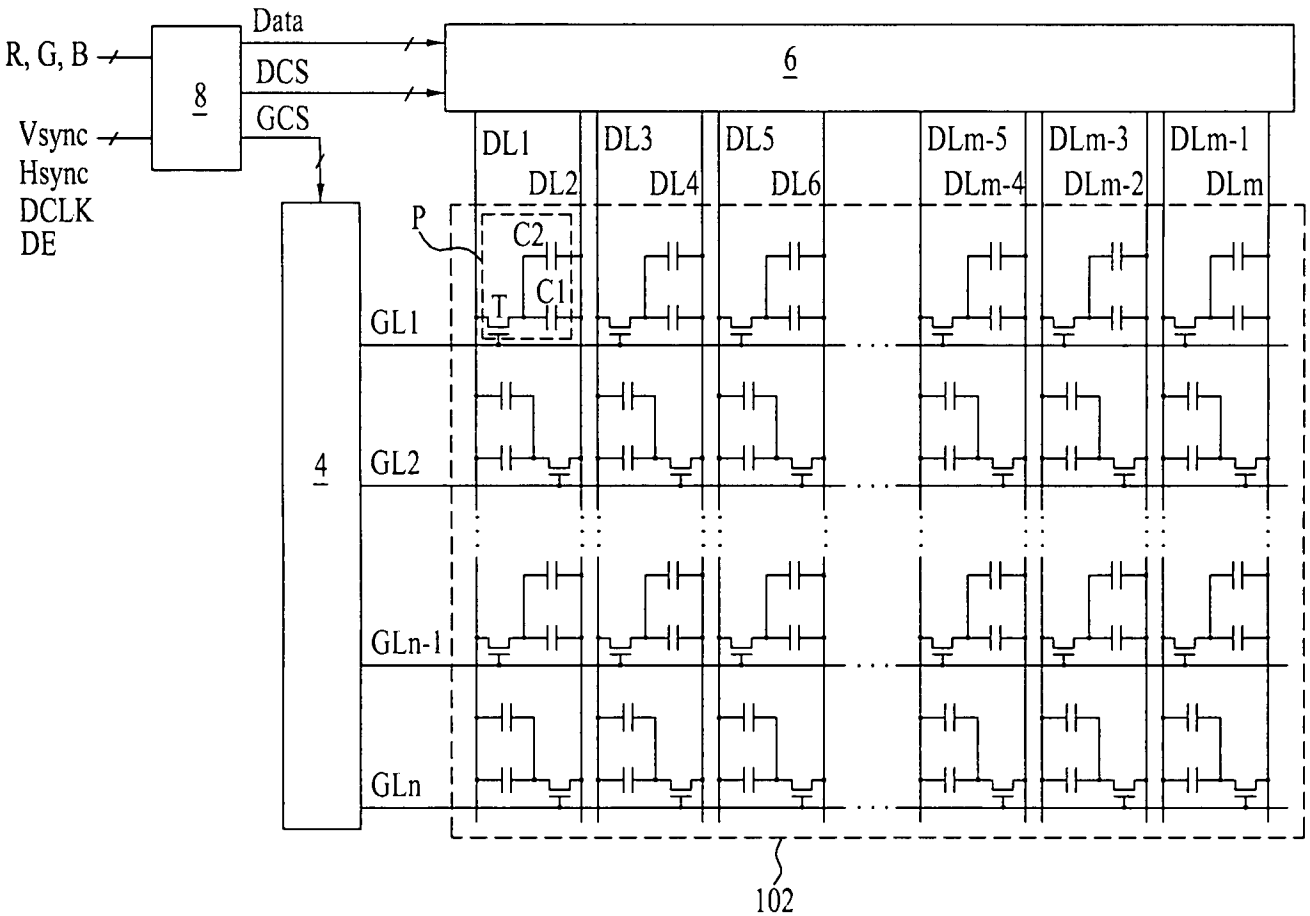
FIG. 6 is a schematic view of a liquid crystal display device according to a second embodiment of the present invention.
Figure 7:
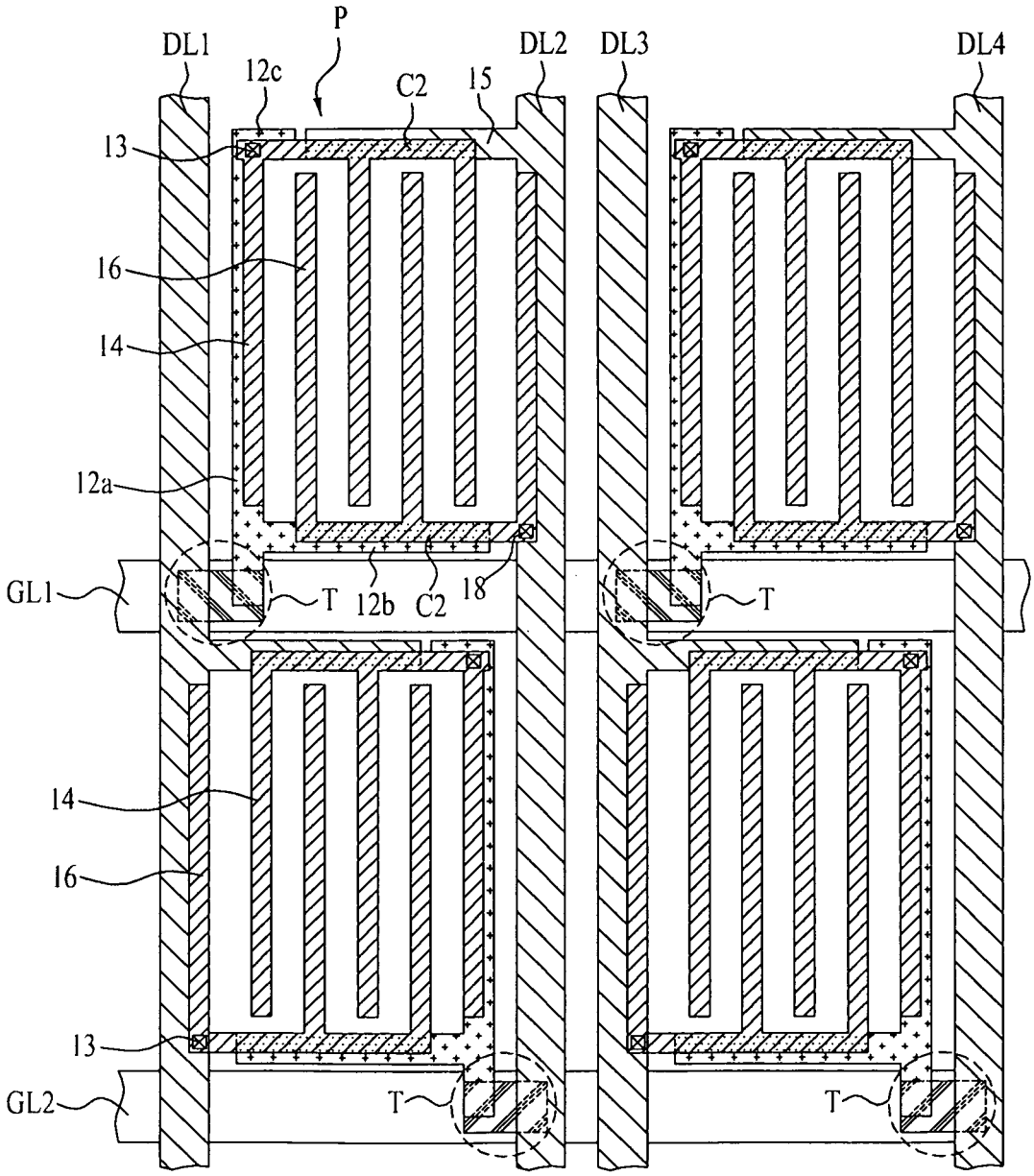
FIG. 7 is a plan view showing a layout of liquid crystal cells formed in an image display panel shown in FIG. 6.

FIG. 6 is a schematic view of a liquid crystal display device according to a second embodiment of the present invention, and FIG. 7 is a plan view showing a layout of liquid crystal cells formed in an image display panel shown in FIG. 6.

Referring to FIGS. 6 and 7, the liquid crystal display device according to the second embodiment of the present invention is the same in configuration as the above-described liquid crystal display device according to the first embodiment of the present invention, with the exception of a connection structure of each liquid crystal cell formed in an image display panel 102. Therefore, a description of the configuration of the liquid crystal display device according to the second embodiment of the present invention, except the connection structure of each liquid crystal cell, will be replaced by the above description of the first embodiment of the present invention.

The thin film transistors T of the liquid crystal cells P of each horizontal line are connected to the same gate line GL, and the thin film transistors T of the liquid crystal cells P of each vertical line are alternately arranged between two horizontally adjacent data lines.

In detail, each of the thin film transistors T of the liquid crystal cells P of the odd horizontal lines is connected to a corresponding one of the odd gate lines GL1, GL3, GL5, . . . , GLn−1 and a corresponding one of the odd data lines DL1, DL3, DL5, . . . , DLm−1. These liquid crystal cells P of the odd horizontal lines have the same connection structures as those of the above-described liquid crystal cells of the first embodiment of the present invention.

Each of the thin film transistors T of the liquid crystal cells P of the even horizontal lines is connected to a corresponding one of the even gate lines GL2, GL4, GL6, GLn and a corresponding one of the even data lines DL2, DL4, DL6, . . . , DLm. Each of the liquid crystal cells P of the even horizontal lines drives a liquid crystal by forming an electric field based on a potential difference of a second image signal which is supplied from a corresponding one of the even data lines DL2, DL4, DL6, . . . , DLm to the pixel electrode 14 from a first image signal which is supplied from a corresponding one of the odd data lines DL1, DL3, DL5, DLm−1.

Figure 8A:
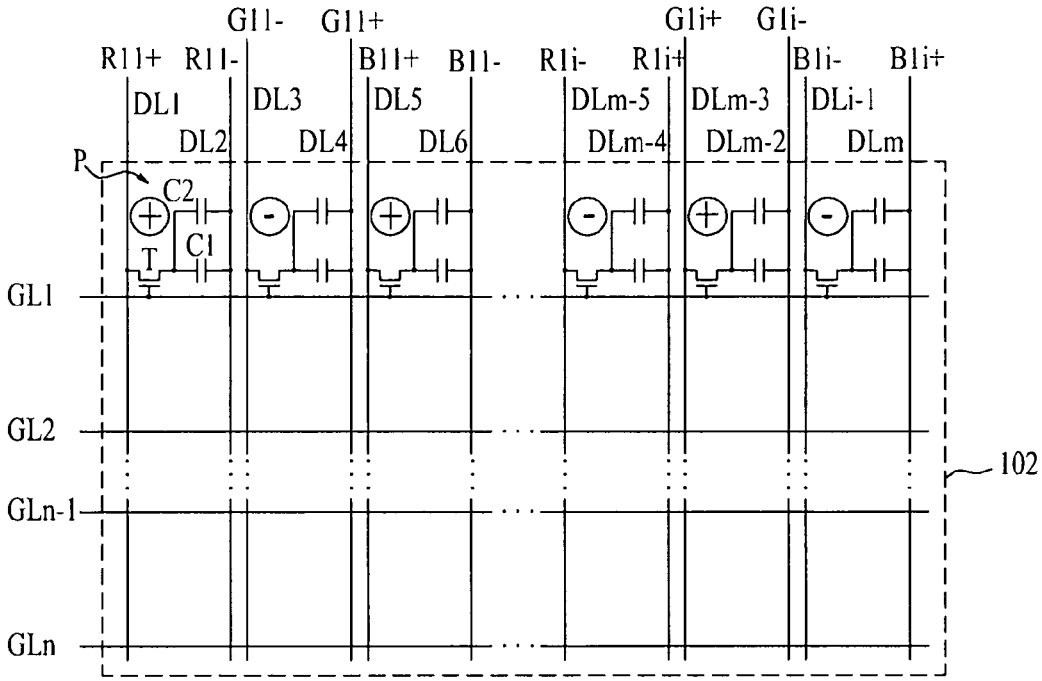
FIGS. 8A and 8B are views stepwise illustrating a driving method of the liquid crystal display device according to the second embodiment of the present invention.
Figure 8B:
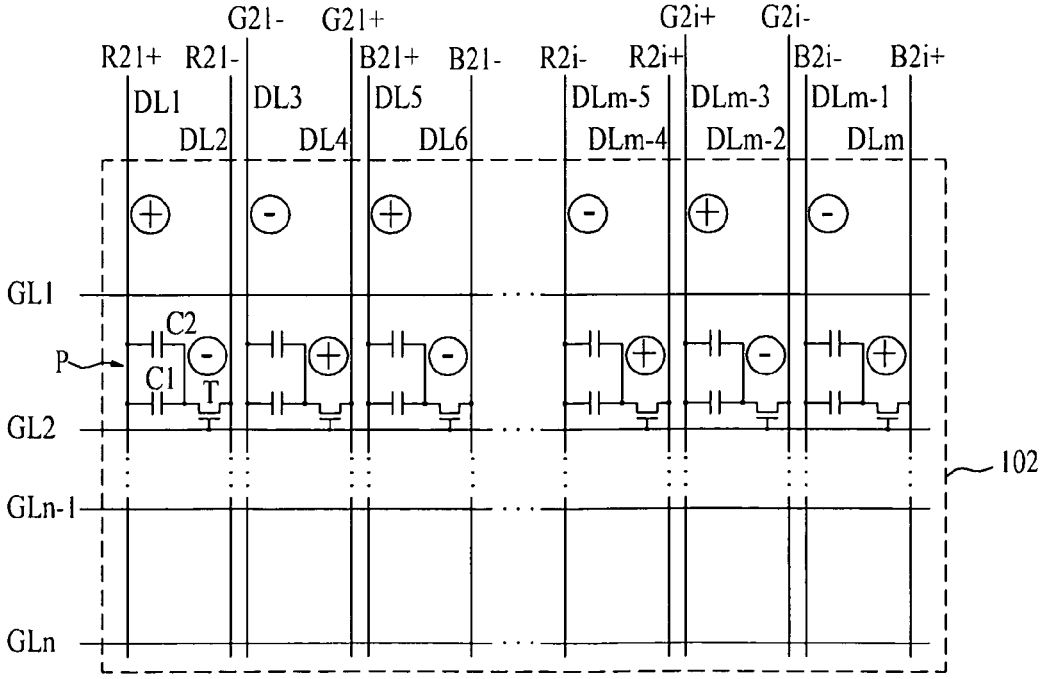

FIGS. 8A and 8B are views stepwise illustrating the polarities of image signals supplied to the image display panel and the polarities of the liquid crystal cells of the image display panel, in a driving method of the liquid crystal display device according to the second embodiment of the present invention. FIGS. 8A and 8B show only liquid crystal cells to which image signals are supplied.

First, the gate pulse is supplied to the first gate line GL1 by the gate driving circuit 4. In synchronization with this, the data driving circuit 6 supplies first image signals R11+, G11−, B11+, . . . , B1*i*− respectively to the odd data lines DL1, DL3, DL5, . . . , DLm−1 and supplies second image signals R11−, G11+, B11−, . . . , B1*i*+ respectively to the even data lines DL2, DL4, DL6, . . . , DLm, as shown in FIG. 8A. As a result, each of the liquid crystal cells P of the first horizontal line displays an image which is inverted in polarity for every liquid crystal cell P, by driving the liquid crystal with an electric field based on a potential difference of the first image signal supplied to the pixel electrode 14 from the second image signal supplied to the opposite electrode 16.

Thereafter, the gate pulse is supplied to the second gate line GL2 by the gate driving circuit 4. In synchronization with this, the data driving circuit 6 supplies first image signals R21+, G21−, B21+, . . . , B2*i*− respectively to the odd data lines DL1, DL3, DL5, . . . , DLm−1 and supplies second image signals R21−, G21+, B21−, . . . , B2*i*+ respectively to the even data lines DL2, DL4, DL6, . . . , DLm, as shown in FIG. 8B. At this time, the polarity of the image signal supplied to each data line DL is the same as that of the image signal supplied to each liquid crystal cell of the first horizontal line. As a result, each of the liquid crystal cells P of the second horizontal line displays an image which is inverted in polarity for every liquid crystal cell P, by driving the liquid crystal with an electric field based on a potential difference of the second image signal supplied to the pixel electrode 14 from the first image signal supplied to the opposite electrode 16.

The liquid crystal cells of the remaining third to nth horizontal lines corresponding respectively to the third to nth gate lines GL3 to GLn display images in the same manner as those of the first and second horizontal lines described above. Therefore, displayed on the image display panel is an image having a polarity pattern of a 1-dot inversion scheme where image signals are inverted in polarity on a liquid crystal cell basis.

On the other hand, although the polarity pattern of the image displayed on the image display panel has been described to be based on the 1-dot inversion scheme, the present invention is not limited thereto. For example, the polarity pattern of the displayed image may be set based on the polarity control signal of the data control signal.

As described above, the liquid crystal display device and the driving method thereof according to the second embodiment of the present invention provide the same effects as those of the first embodiment of the present invention, stated previously. Also, in the second embodiment of the present invention, the thin film transistors T of the liquid crystal cells P are alternately arranged in the data line direction. Therefore, for display of an image having a polarity pattern based on the 1-dot inversion scheme on the image display panel 102, the polarities of image signals outputted from the data driving circuit 6 are inverted for every pair of data lines and for every at least one frame, thereby reducing power consumption of the data driving circuit 6. Of course, the power consumption of the data driving circuit 6 according to the second embodiment of the present invention can be reduced similarly in other inversion schemes, as well as in the 1-dot inversion scheme.

Figure 9:
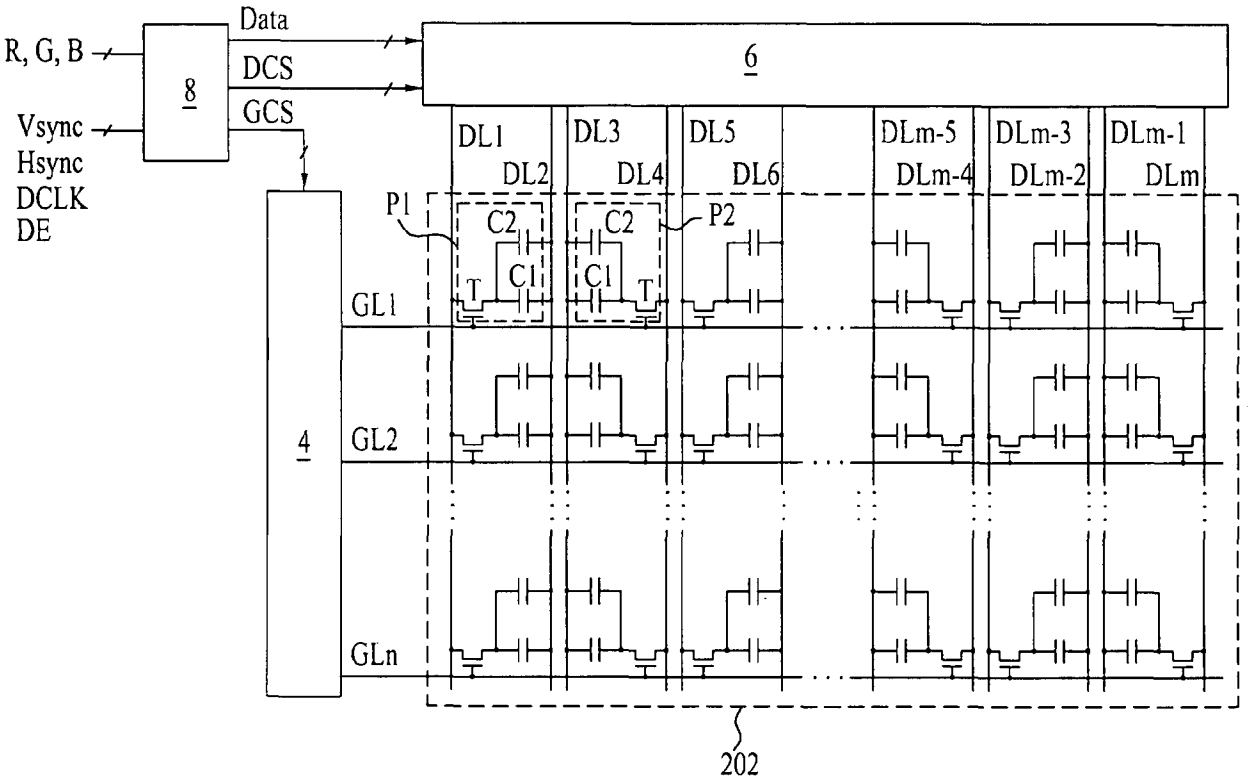
FIG. 9 is a schematic view of a liquid crystal display device according to a third embodiment of the present invention.
Figure 10:
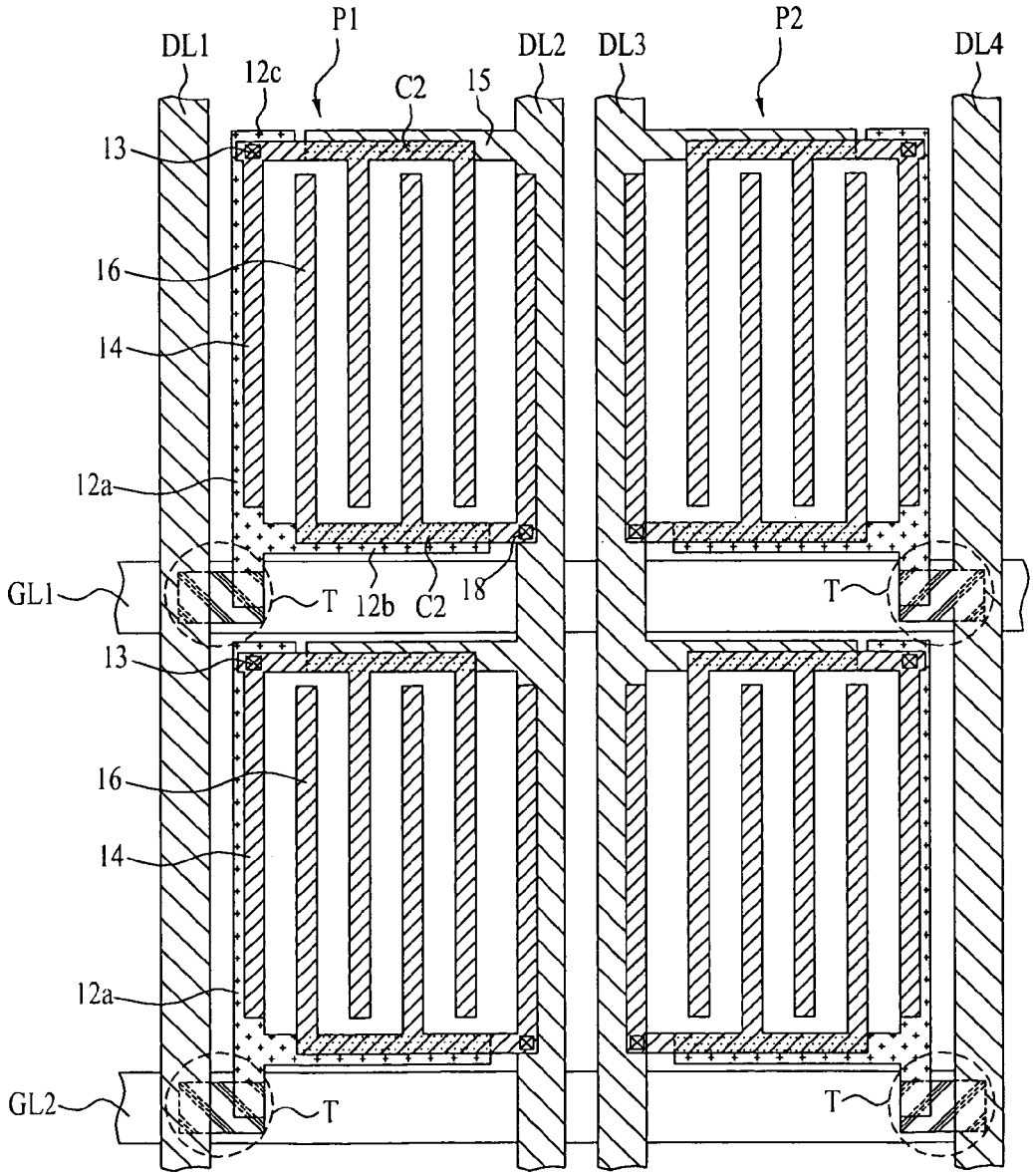
FIG. 10 is a plan view showing a layout of liquid crystal cells formed in an image display panel shown in FIG. 9.

FIG. 9 is a schematic view of a liquid crystal display device according to a third embodiment of the present invention, and FIG. 10 is a plan view showing a layout of liquid crystal cells formed in an image display panel shown in FIG. 9.

Referring to FIGS. 9 and 10, the liquid crystal display device according to the third embodiment of the present invention is the same in configuration as the above-described liquid crystal display device according to the first embodiment of the present invention, with the exception of a connection structure of each liquid crystal cell formed in an image display panel 202. Therefore, a description of the configuration of the liquid crystal display device according to the third embodiment of the present invention, except the connection structure of each liquid crystal cell, will be replaced by the above description of the first embodiment of the present invention.

Each horizontal line of the image display panel 202 includes odd liquid crystal cells (referred to hereinafter as a "first liquid crystal cell group") P1, each for driving a liquid crystal based on a gate pulse from a corresponding one of the gate lines GL1 to GLn, a first image signal from a (4j−3)th (where j is a natural number which is m/4) one DL1, DL5, . . . , or DLm−3 of the data lines DL1 to DLm and a second image signal from a (4j−2)th one DL2, DL6, . . . , or DLm−2 of the data lines DL1 to DLm, and even liquid crystal cells (referred to hereinafter as a "second liquid crystal cell group") P2, each for driving a liquid crystal based on the gate pulse from the corresponding one of the gate lines GL1 to GLn, a first image signal from a (4j−1)th one DL3, DL7, . . . , or DLm−1 of the data lines DL1 to DLm and a second image signal from a (4j)th one DL4, DL8, . . . , or DLm of the data lines DL1 to DLm.

Each of the liquid crystal cells P1 of the first liquid crystal cell group includes a thin film transistor T connected to the corresponding one of the gate lines GL1 to GLn and to the (4j−3)th data line DL1, DL5, . . . , or DLm−3, and a liquid crystal capacitor C1 and a storage capacitor C2 each connected between the thin film transistor T and the (4j−2)th data line DL2, DL6, . . . , or DLm−2. Here, the thin film transistor T, liquid crystal capacitor C1 and storage capacitor C2 are configured as shown in FIG. 10 and have the same structures as those of the first embodiment of the present invention, stated previously, and a description thereof will thus be replaced by the above description of the first embodiment of the present invention. Each of the liquid crystal cells P1 of the first liquid crystal cell group, configured in this manner, drives the liquid crystal by forming a horizontal electric field based on a potential difference of the first image signal supplied from the (4j−3)th data line DL1, DL5, . . . , or DLm−3 from the second image signal supplied from the (4j−2)th data line DL2, DL6, . . . , or DLm−2 as a reference voltage.

Each of the liquid crystal cells P2 of the second liquid crystal cell group includes a thin film transistor T connected to the corresponding one of the gate lines GL1 to GLn and to the (4j)th data line DL4, DL8, . . . , or DLm, and a liquid crystal capacitor C1 and a storage capacitor C2 each connected between the thin film transistor T and the (4j−1)th data line DL3, DL7, . . . , or DLm−1. Here, the thin film transistor T, liquid crystal capacitor C1 and storage capacitor C2 are configured as shown in FIG. 10 and have the same structures as those of the first embodiment of the present invention, stated previously, and a description thereof will thus be replaced by the above description of the first embodiment of the present invention. Each of the liquid crystal cells P2 of the second liquid crystal cell group, configured in this manner, drives the liquid crystal by forming a horizontal electric field based on a potential difference of the second image signal supplied from the (4j)th data line DL4, DL8, . . . , or DLm from the first image signal supplied from the (4j−1)th data line DL3, DL7, . . . , or DLm−1 as a reference voltage.

Figure 11A:
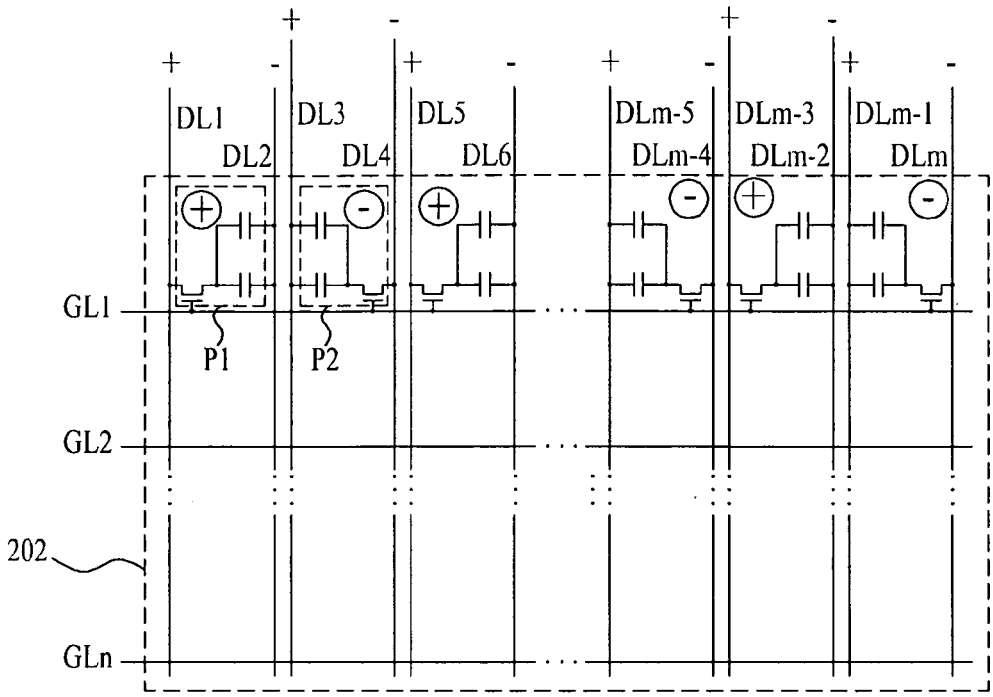
FIGS. 11A and 11B are views stepwise illustrating a driving method of the liquid crystal display device according to the third embodiment of the present invention.
Figure 11B:
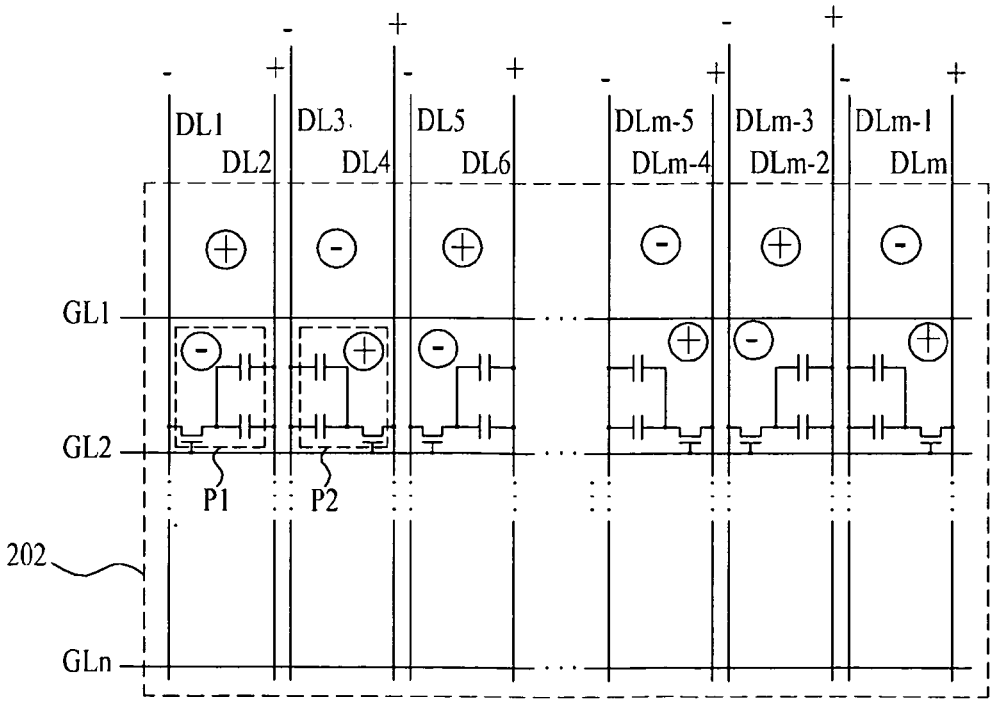

FIGS. 11A and 11B are views stepwise illustrating the polarities of image signals supplied to the image display panel 202 and the polarities of the liquid crystal cells of the image display panel 202, in a driving method of the liquid crystal display device according to the third embodiment of the present invention. FIGS. 11A and 11B show only liquid crystal cells to which image signals are supplied.

First, the gate pulse is supplied to the first gate line GL1 by the gate driving circuit 4. In synchronization with this, the data driving circuit 6 supplies positive (+) first image signals respectively to the odd data lines DL1, DL3, DL5, . . . , DLm−1 and supplies negative (−) second image signals respectively to the even data lines DL2, DL4, DL6, . . . , DLm, as shown in FIG. 11A. As a result, each of the liquid crystal cells P1 of the first liquid crystal cell group of the first horizontal line displays a positive image (+) by driving the liquid crystal with an electric field based on a potential difference of the positive first image signal supplied to the pixel electrode 14 from the negative second image signal supplied to the opposite electrode 16. Also, each of the liquid crystal cells P2 of the second liquid crystal cell group of the first horizontal line displays a negative image (−) by driving the liquid crystal with an electric field based on a potential difference of the negative second image signal supplied to the pixel electrode 14 from the positive first image signal supplied to the opposite electrode 16.

Thereafter, the gate pulse is supplied to the second gate line GL2 by the gate driving circuit 4. In synchronization with this, the data driving circuit 6 supplies negative-first image signals respectively to the odd data lines DL1, DL3, DL5, . . . , DLm−1 and supplies positive second image signals respectively to the even data lines DL2, DL4, DL6, . . . , DLm, as shown in FIG. 11B. At this time, the polarity of the image signal supplied to each data line DL is opposite to that of the image signal supplied to each liquid crystal cell of the first horizontal line. As a result, each of the liquid crystal cells P1 of the first liquid crystal cell group of the second horizontal line displays a negative image (−) by driving the liquid crystal with an electric field based on a potential difference of the negative (−) first image signal supplied to the pixel electrode 14 from the positive (+) second image signal supplied to the opposite electrode 16. Also, each of the liquid crystal cells P2 of the second liquid crystal cell group of the second horizontal line displays a positive image (+) by driving the liquid crystal with an electric field based on a potential difference of the positive (+) second image signal supplied to the pixel electrode 14 from the negative (−) first image signal supplied to the opposite electrode 16.

The liquid crystal cells of the remaining third to nth horizontal lines corresponding respectively to the third to nth gate lines GL3 to GLn display images in the same manner as those of the first and second horizontal lines described above. Therefore, displayed on the image display panel is an image having a polarity pattern of a 1-dot inversion scheme where image signals are inverted in polarity on a liquid crystal cell basis.

On the other hand, although the polarity pattern of the image displayed on the image display panel has been described to be based on the 1-dot inversion scheme, the present invention is not limited thereto. For example, the polarity pattern of the displayed image may be set based on the polarity control signal of the data control signal.

As described above, the liquid crystal display device and the driving method thereof according to the third embodiment of the present invention provide the same effects as those of the first embodiment of the present invention, stated previously.

Figure 12:
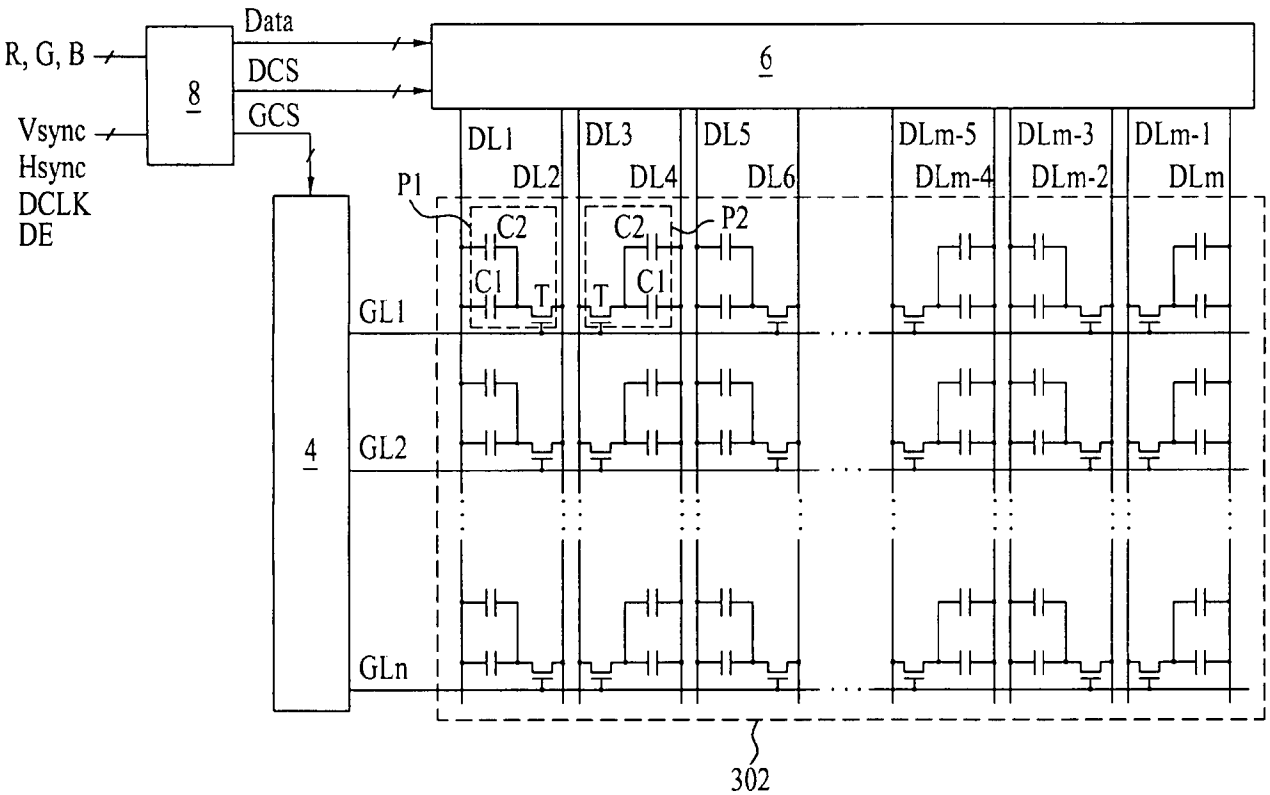
FIG. 12 is a schematic view of a liquid crystal display device according to a fourth embodiment of the present invention.
Figure 13:
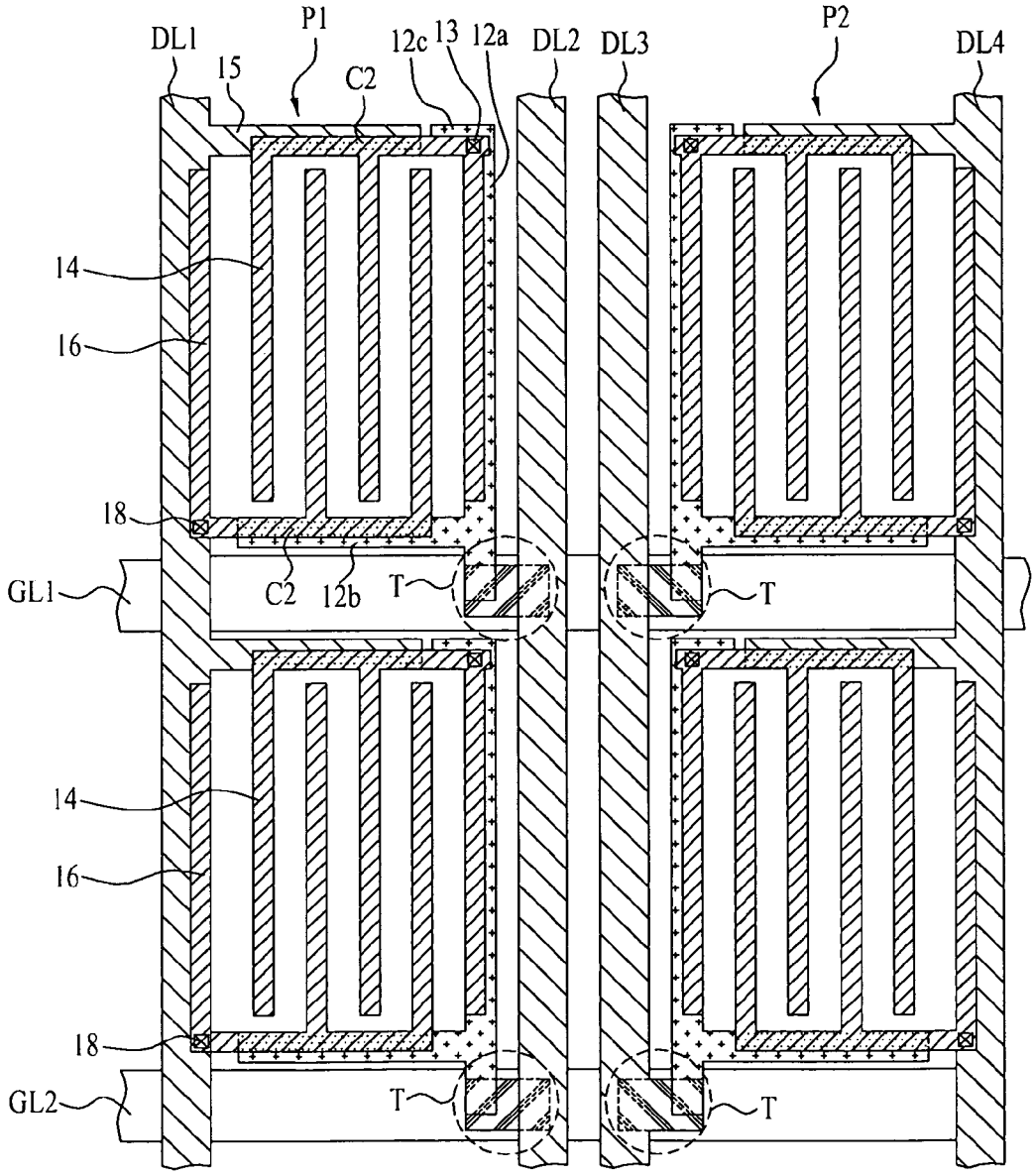
FIG. 13 is a plan view showing a layout of liquid crystal cells formed in an image display panel shown in FIG. 12.

FIG. 12 is a schematic view of a liquid crystal display device according to a fourth embodiment of the present invention, and FIG. 13 is a plan view showing a layout of liquid crystal cells formed in an image display panel shown in FIG. 12.

Referring to FIGS. 12 and 13, the liquid crystal display device according to the fourth embodiment of the present invention is the same in configuration as the above-described liquid crystal display device according to the third embodiment of the present invention, with the exception of a connection structure of each liquid crystal cell formed in an image display panel 302. Therefore, a description of the configuration of the liquid crystal display device according to the fourth embodiment of the present invention, except the connection structure of each liquid crystal cell, will be replaced by the above description of the first and third embodiments of the present invention.

Each of the liquid crystal cells P1 of the first liquid crystal cell group includes a thin film transistor T connected to the corresponding one of the gate lines GL1 to GLn and to the (4j−2)th data line DL2, DL6, . . . , or DLm−2, and a liquid crystal capacitor C1 and a storage capacitor C2 each connected between the thin film transistor T and the (4j−3)th data line DL1, DL5, . . . , or DLm−3. Here, the thin film transistor T, liquid crystal capacitor C1 and storage capacitor C2 are configured as shown in FIG. 13 and have the same structures as those of the first embodiment of the present invention, stated previously, and a description thereof will thus be replaced by the above description of the first embodiment of the present invention. Each of the liquid crystal cells P1 of the first liquid crystal cell group, configured in this manner, drives the liquid crystal by forming a horizontal electric field based on a potential difference of the second image signal supplied from the (4j−2)th data line DL2, DL6, . . . , or DLm−2 from the first image signal supplied from the (4j−3)th data line DL1, DL5, . . . , or DLm−3 as a reference voltage.

Each of the liquid crystal cells P2 of the second liquid crystal cell group includes a thin film transistor T connected to the corresponding one of the gate lines GL1 to GLn and to the (4j−1)th data line DL3, DL7, . . . , or DLm−1, and a liquid crystal capacitor C1 and a storage capacitor C2 each connected between the thin film transistor T and the (4j) th data line DL4, DL8, . . . , or DLm. Here, the thin film transistor T, liquid crystal capacitor C1 and storage capacitor C2 are configured as shown in FIG. 13 and have the same structures as those of the first embodiment of the present invention, stated previously, and a description thereof will thus be replaced by the above description of the first embodiment of the present invention. Each of the liquid crystal cells P2 of the second liquid crystal cell group, configured in this manner, drives the liquid crystal by forming a horizontal electric field based on a potential difference of the first image signal supplied from the (4j−1)th data line DL3, DL7, . . . , or DLm−1 from the second image signal supplied from the (4j)th data line DL4, DL8, . . . , or DLm as a reference voltage.

Figure 14A:
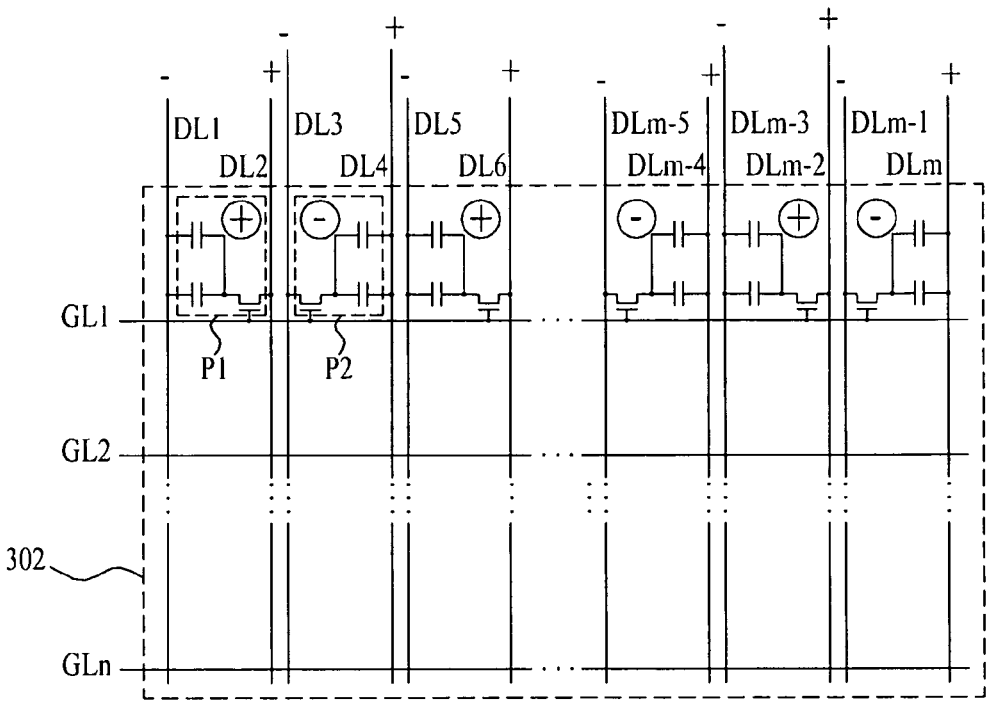
FIGS. 14A and 14B are views stepwise illustrating a driving method of the liquid crystal display device according to the fourth embodiment of the present invention.
Figure 14B:
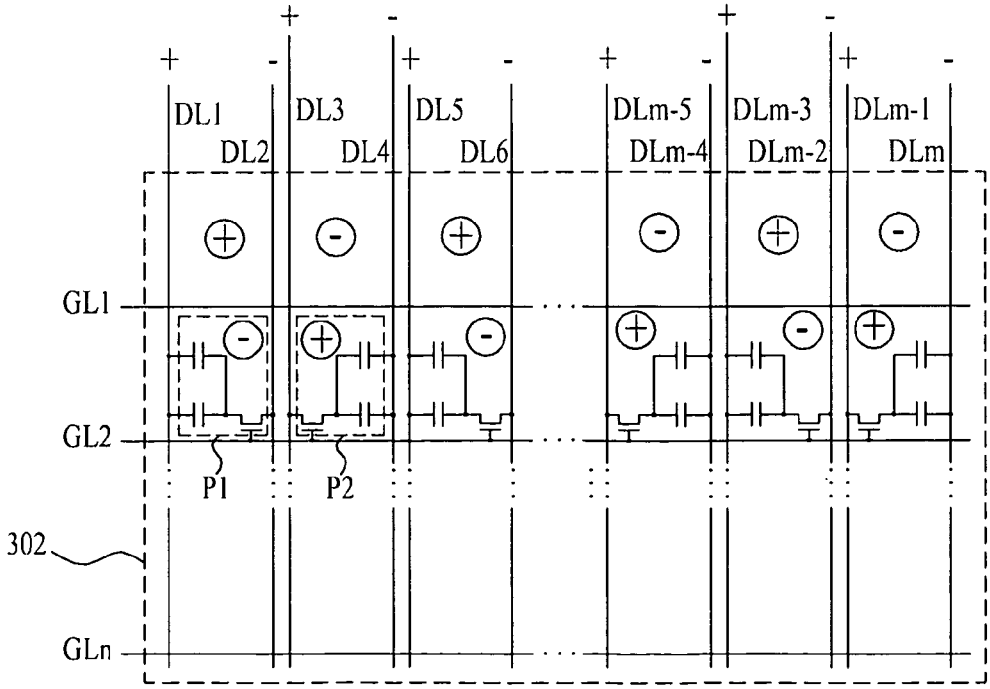

FIGS. 14A and 14B are views stepwise illustrating the polarities of image signals supplied to the image display panel and the polarities of the liquid crystal cells of the image display panel, in a driving method of the liquid crystal display device according to the fourth embodiment of the present invention. FIGS. 14A and 14B show only liquid crystal cells to which image signals are supplied.

First, the gate pulse is supplied to the first gate line GL1 by the gate driving circuit 4. In synchronization with this, the data driving circuit 6 supplies negative (−) first image signals respectively to the odd data lines DL1, DL3, DL5, . . . , DLm−1 and supplies positive (+) second image signals respectively to the even data lines DL2, DL4, DL6, . . . , DLm, as shown in FIG. 14A. As a result, each of the liquid crystal cells P1 of the first liquid crystal cell group of the first horizontal line displays a positive image (+) by driving the liquid crystal with an electric field based on a potential difference of the positive second image signal supplied to the pixel electrode 14 from the negative first image signal supplied to the opposite electrode 16. Also, each of the liquid crystal cells P2 of the second liquid crystal cell group of the first horizontal line displays a negative image (−) by driving the liquid crystal with an electric field based on a potential difference of the negative first image signal supplied to the pixel electrode 14 from the positive second image signal supplied to the opposite electrode 16.

Thereafter, the gate pulse is supplied to the second gate line GL2 by the gate driving circuit 4. In synchronization with this, the data driving circuit 6 supplies positive (+) first image signals respectively to the odd data lines DL1, DL3, DL5, . . . , DLm−1 and supplies negative (−) second image signals respectively to the even data lines DL2, DL4, DL6, . . . , DLm, as shown in FIG. 14B. At this time, the polarity of the image signal supplied to each data line DL is opposite to that of the image signal supplied to each liquid crystal cell of the first horizontal line. As a result, each of the liquid crystal cells P1 of the first liquid crystal cell group of the second horizontal line displays a negative image (−) by driving the liquid crystal with an electric field based on a potential difference of the negative (−) second image signal supplied to the pixel electrode 14 from the positive (+) first image signal supplied to the opposite electrode 16. Also, each of the liquid crystal cells P2 of the second liquid crystal cell group of the second horizontal line displays a positive image (+) by driving the liquid crystal with an electric field based on a potential difference of the positive (+) first image signal supplied to the pixel electrode 14 from the negative (−) second image signal supplied to the opposite electrode 16.

The liquid crystal cells of the remaining third to nth horizontal lines corresponding respectively to the third to nth gate lines GL3 to GLn display images in the same manner as those of the first and second horizontal lines described above. Therefore, displayed on the image display panel is an image having a polarity pattern of a 1-dot inversion scheme where image signals are inverted in polarity on a liquid crystal cell basis.

On the other hand, although the polarity pattern of the image displayed on the image display panel has been described to be based on the 1-dot inversion scheme, the present invention is not limited thereto. For example, the polarity pattern of the displayed image may be set based on the polarity control signal of the data control signal.

As described above, the liquid crystal display device and the driving method thereof according to the fourth embodiment of the present invention provide the same effects as those of the first embodiment of the present invention, stated previously.

Figure 15:
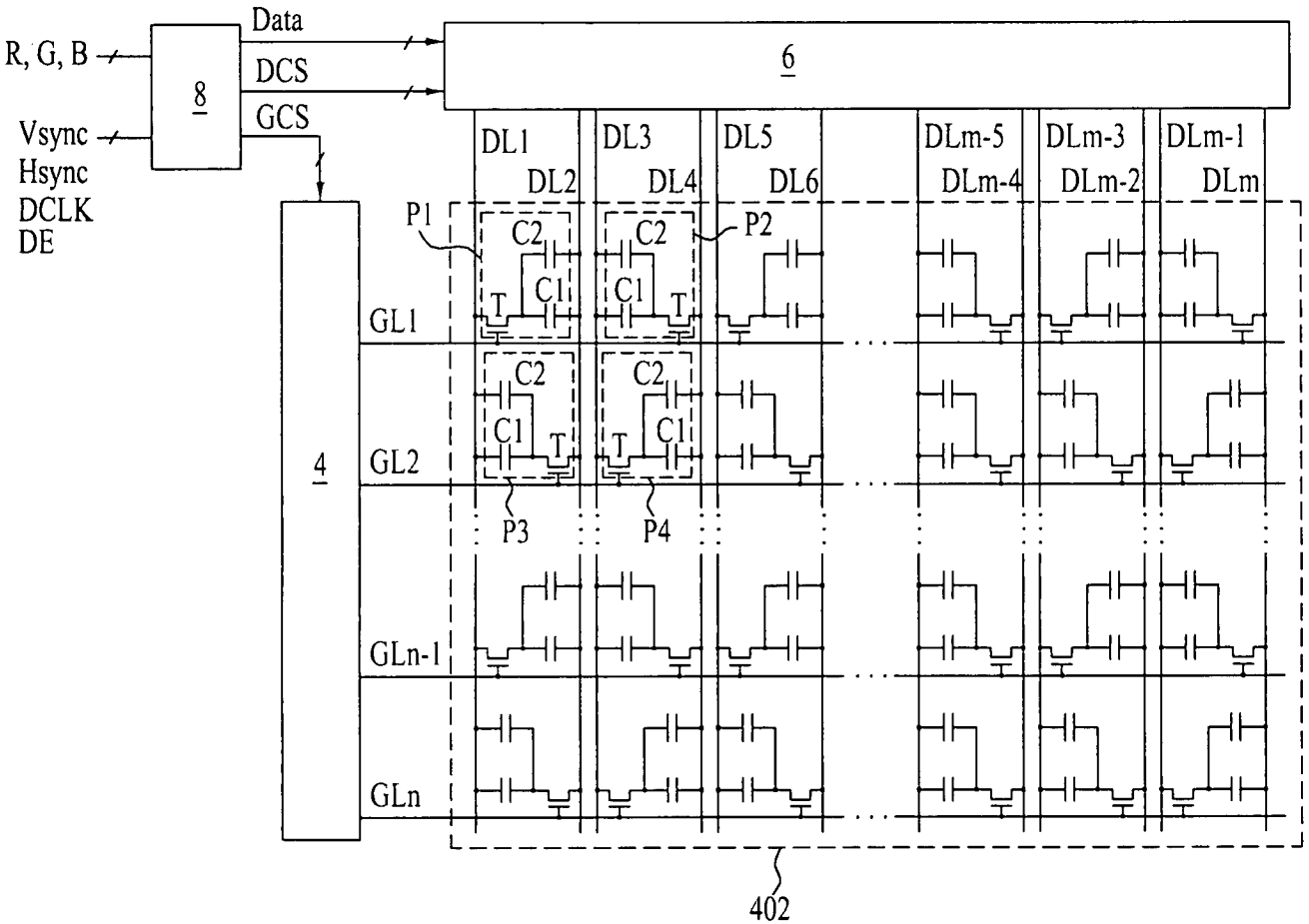
FIG. 15 is a schematic view of a liquid crystal display device according to a fifth embodiment of the present invention.
Figure 16:
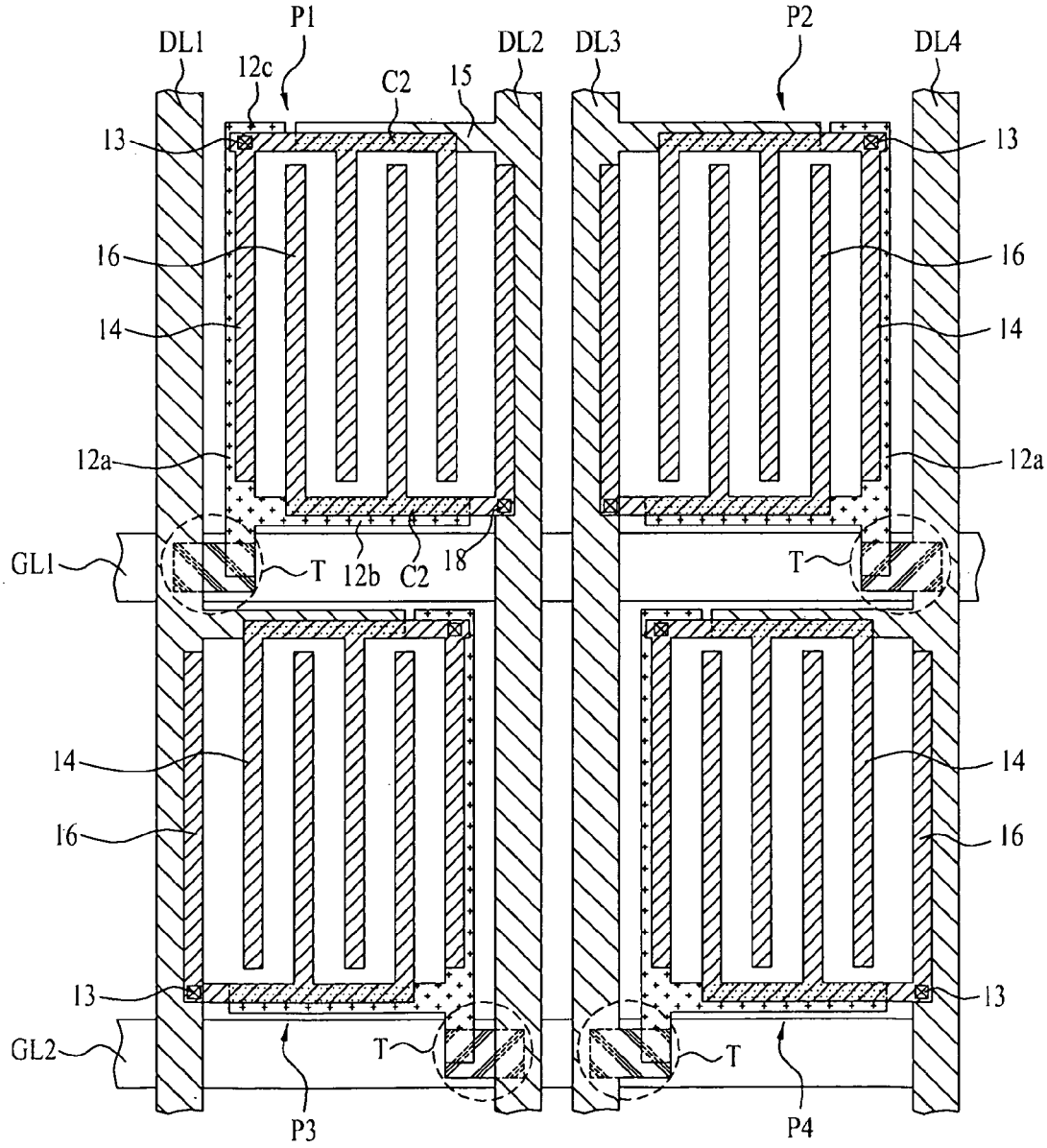
FIG. 16 is a plan view showing a layout of liquid crystal cells formed in an image display panel shown in FIG. 15.

FIG. 15 is a schematic view of a liquid crystal display device according to a fifth embodiment of the present invention, and FIG. 16 is a plan view showing a layout of liquid crystal cells formed in an image display panel shown in FIG. 15.

Referring to FIGS. 15 and 16, the liquid crystal display device according to the fifth embodiment of the present invention is the same in configuration as the above-described liquid crystal display device according to the first embodiment of the present invention, with the exception of a connection structure of each liquid crystal cell formed in an image display panel 402. Therefore, a description of the configuration of the liquid crystal display device according to the fifth embodiment of the present invention, except the connection structure of each liquid crystal cell, will be replaced by the above description of the first embodiment of the present invention.

The image display panel 402 includes odd horizontal lines including odd liquid crystal cells (referred to hereinafter as a "first liquid crystal cell group") P1, each for driving a liquid crystal based on a gate pulse from a corresponding one of the odd gate lines GL1, GL3, . . . , GLn−1, a first image signal from a (4j−3)th (where j is a natural number which is m/4) one DL1, DL5, . . . , or DLm−3 of the data lines DL1 to DLm and a second image signal from a (4j−2)th one DL2, DL6, . . . , or DLm−2 of the data lines DL1 to DLm, and even liquid crystal cells (referred to hereinafter as a "second liquid crystal cell group") P2, each for driving a liquid crystal based on a gate pulse from a corresponding one of the odd gate lines GL1, GL3, . . . , GLn−1, a first image signal from a (4j−1)th one DL3, DL7, . . . , or DLm−1 of the data lines DL1 to DLm and a second image signal from a (4j)th one DL4, DL8, . . . , or DLm of the data lines DL1 to DLm, and even horizontal lines including odd liquid crystal cells (referred to hereinafter as a "third liquid crystal cell group") P3, each for driving a liquid crystal based on a gate pulse from a corresponding one of the even gate lines GL2, GL4, . . . , GLn, the first image signal from the (4j−3)th data line DL1, DL5, . . . , or DLm−3 and the second image signal from the (4j−2)th data lines DL2, DL6, . . . , or DLm−2, and even liquid crystal cells (referred to hereinafter as a "fourth liquid crystal cell group") P4, each for driving a liquid crystal based on a gate pulse from a corresponding one of the even gate lines GL2, GL4, . . . , GLn, the first image signal from the (4j−1)th data line DL3, DL7, . . . , or DLm−1 and the second image signal from the (4j)th data line DL4, DL8, . . . , or DLm.

Each of the liquid crystal cells P1 of the first liquid crystal cell group includes a thin film transistor T connected to the corresponding one of the odd gate lines GL1, GL3, . . . , GLn−1 and to the (4j−3)th data line DL1, DL5, or DLm−3, and a liquid crystal capacitor C1 and a storage capacitor C2 each connected between the thin film transistor T and the (4j−2)th data line DL2, DL6, . . . , or DLm−2. Here, the thin film transistor T, liquid crystal capacitor C1 and storage capacitor C2 are configured as shown in FIG. 16 and have the same structures as those of the first embodiment of the present invention, stated previously, and a description thereof will thus be replaced by the above description of the first embodiment of the present invention. Each of the liquid crystal cells P1 of the first liquid crystal cell group, configured in this manner, drives the liquid crystal by forming a horizontal electric field based on a potential difference of the first image signal supplied from the (4j−3)th data line DL1, DL5, . . . , or DLm−3 from the second image signal supplied from the (4j−2)th data line DL2, DL6, . . . , or DLm−2 as a reference voltage.

Each of the liquid crystal cells P2 of the second liquid crystal cell group includes a thin film transistor T connected to the corresponding one of the odd gate lines GL1, GL3, . . . , GLn−1 and to the (4j)th data line DL4, DL8, . . . , or DLm, and a liquid crystal capacitor C1 and a storage capacitor C2 each connected between the thin film transistor T and the (4j−1)th data line DL3, DL7, . . . , or DLm−1. Here, the thin film transistor T, liquid crystal capacitor C1 and storage capacitor C2 are configured as shown in FIG. 16 and have the same structures as those of the first embodiment of the present invention, stated previously, and a description thereof will thus be replaced by the above description of the first embodiment of the present invention. Each of the liquid crystal cells P2 of the second liquid crystal cell group, configured in this manner, drives the liquid crystal by forming a horizontal electric field based on a potential difference of the second image signal supplied from the (4j)th data line DL4, DL8, . . . , or DLm from the first image signal supplied from the (4j−1)th data line DL3, DL7, . . . , or DLm−1 as a reference voltage.

Each of the liquid crystal cells P3 of the third liquid crystal cell group includes a thin film transistor T connected to the corresponding one of the even gate lines GL2, GL4, . . . , GLn and to the (4j−2)th data line DL2, DL6, . . . , or DLm−2, and a liquid crystal capacitor C1 and a storage capacitor C2 each connected between the thin film transistor T and the (4j−3)th data line DL1, DL5, . . . , or DLm−3. Here, the thin film transistor T, liquid crystal capacitor C1 and storage capacitor C2 are configured as shown in FIG. 16 and have the same structures as those of the first embodiment of the present invention, stated previously, and a description thereof will thus be replaced by the above description of the first embodiment of the present invention. Each of the liquid crystal cells P3 of the third liquid crystal cell group, configured in this manner, drives the liquid crystal by forming a horizontal electric field based on a potential difference of the second image signal supplied from the (4j−2)th data line DL2, DL6, . . . , or DLm−2 from the first image signal supplied from the (4j−3)th data line DL1, DL5, . . . , or DLm−3 as a reference voltage.

Each of the liquid crystal cells P4 of the fourth liquid crystal cell group includes a thin film transistor T connected to the corresponding one of the even gate lines GL2, GL4, . . . , GLn and to the (4j−1)th data line DL3, DL7, . . . , or DLm−1, and a liquid crystal capacitor C1 and a storage capacitor C2 each connected between the thin film transistor T and the (4j)th data line DL4, DL8, . . . , or DLm. Here, the thin film transistor T, liquid crystal capacitor C1 and storage capacitor C2 are configured as shown in FIG. 16 and have the same structures as those of the first embodiment of the present invention, stated previously, and a description thereof will thus be replaced by the above description of the first embodiment of the present invention. Each of the liquid crystal cells P4 of the fourth liquid crystal cell group, configured in this manner, drives the liquid crystal by forming a horizontal electric field based on a potential difference of the first image signal supplied from the (4j−1)th data line DL3, DL7, . . . , or DLm−1 from the second image signal supplied from the (4j)th data line DL4, DL8, . . . , or DLm as a reference voltage.

Figure 17:
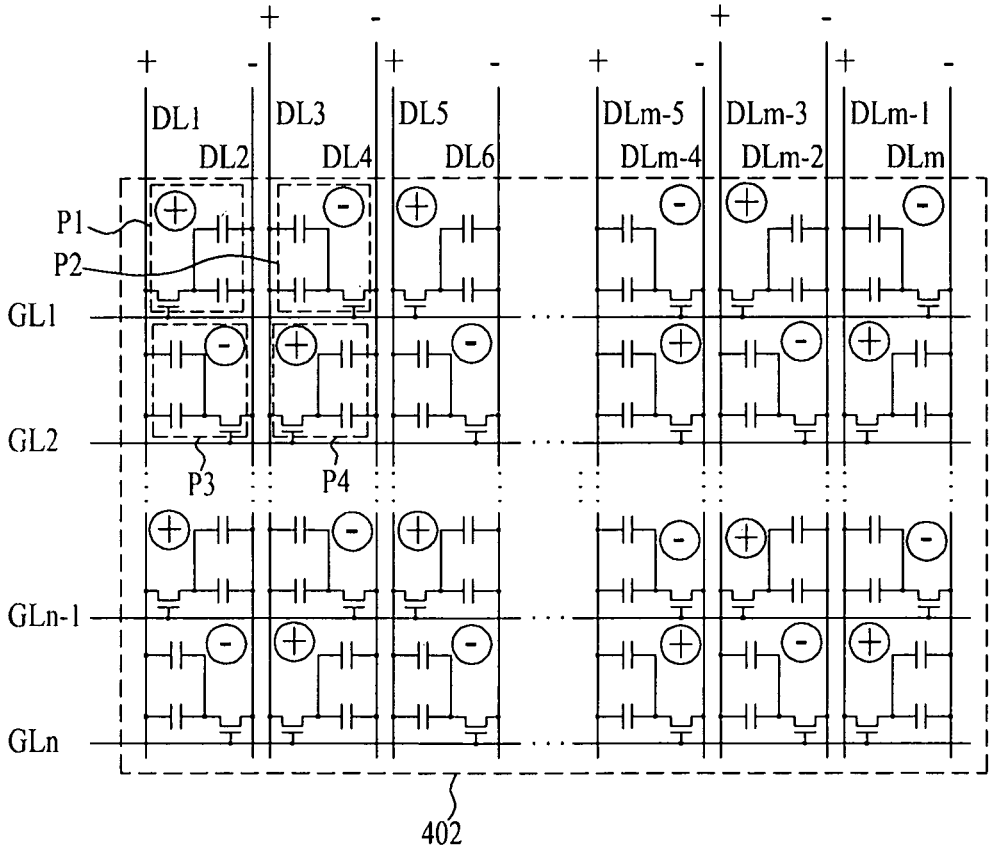
FIG. 17 is a view stepwise illustrating a driving method of the liquid crystal display device according to the fifth embodiment of the present invention.

FIG. 17 is a view illustrating the polarities of image signals supplied to the image display panel and the polarities of the liquid crystal cells of the image display panel, in a driving method of the liquid crystal display device according to the fifth embodiment of the present invention.

First, the gate driving circuit 4 supplies the gate pulse sequentially to the gate lines GL1 to GLn.

In synchronization with the gate pulse supplied to each of the gate lines GL1 to GLn, the data driving circuit 6 supplies positive (+) first image signals respectively to the odd data lines DL1, DL3, DL5, . . . , DLm−1 and supplies negative (−) second image signals respectively to the even data lines DL2, DL4, DL6, . . . , DLm.

As a result, each of the liquid crystal cells P1 of the first liquid crystal cell group formed on the odd horizontal lines displays a positive image (+) by driving the liquid crystal with an electric field based on a potential difference of the positive (+) first image signal supplied to the pixel electrode 14 from the negative (−) second image signal supplied to the opposite electrode 16. Also, each of the liquid crystal cells P2 of the second liquid crystal cell group displays a negative image (−) by driving the liquid crystal with an electric field based on a potential difference of the negative (−) second image signal supplied to the pixel electrode 14 from the positive (+) first image signal supplied to the opposite electrode 16. Consequently, an image which is inverted in polarity for every liquid crystal cell is displayed on the odd horizontal lines.

Also, each of the liquid crystal cells P3 of the third liquid crystal cell group formed on the even horizontal lines displays a negative image (−) by driving the liquid crystal with an electric field based on a potential difference of the negative (−) second image signal supplied to the pixel electrode 14 from the positive (+) first image signal supplied to the opposite electrode 16. Also, each of the liquid crystal cells P4 of the fourth liquid crystal cell group displays a positive image (+) by driving the liquid crystal with an electric field based on a potential difference of the positive (+) first image signal supplied to the pixel electrode 14 from the negative (−) second image signal supplied to the opposite electrode 16. As a result, an image which is inverted in polarity for every liquid crystal cell is displayed on the even horizontal lines.

Consequently, an image displayed on the image display panel 402 has a polarity pattern of a 1-dot inversion scheme.

On the other hand, although the polarity pattern of the image displayed on the image display panel 402 has been described to be based on the 1-dot inversion scheme, the present invention is not limited thereto. For example, the polarity pattern of the displayed image may be set based on the polarity control signal of the data control signal.

As described above, the liquid crystal display device and the driving method thereof according to the fifth embodiment of the present invention provide the same effects as those of the first embodiment of the present invention, stated previously. Further, in the fifth embodiment of the present invention, the thin film transistors T of the liquid crystal cells P are alternately arranged in the data line direction, and arranged in such a manner that a symmetrical structure is defined by every two adjacent ones of the liquid crystal cells P. Therefore, for display of an image having a polarity pattern based on the 1-dot inversion scheme on the image display panel 402, the polarities of image signals outputted from the data driving circuit 6 are inverted for every data line and for every at least one frame, thereby reducing power consumption of the data driving circuit 6. Of course, the power consumption of the data driving circuit 6 according to the fifth embodiment of the present invention can be reduced similarly in other inversion schemes, as well as in the 1-dot inversion scheme.

As apparent from the above description, the liquid crystal display device and the driving method thereof according to the present invention have effects as follows.

Firstly, a common voltage supply line for application of a common voltage to an opposite electrode of each liquid crystal cell is not required, thus increasing an aperture ratio of each liquid crystal cell.

Secondly, because first and second image signals symmetrical to each other are supplied to each liquid crystal cell through two adjacent data lines, occurrence of a horizontal crosstalk can be eliminated. In addition, it is possible to eliminate occurrence of a flicker resulting from a DC component and prevent a liquid crystal from being deteriorated.

Thirdly, the polarity of an image signal to the opposite electrode of each liquid crystal cell is inverted based on an inversion scheme, thereby making it possible to eliminate occurrence of an afterimage resulting from the polarity inversion of the image signal, so as to prevent a picture quality from being degraded.

Fourthly, an image is provided based on the first and second image signals symmetrical to each other. Therefore, the swing width of each image signal can be reduced, thus reducing the amount of heat to be generated in a data driving circuit and the amount of current to be consumed therein. Further, it is possible to drive the liquid crystal with a high voltage, so as to increase a response speed of the liquid crystal.

Fifthly, the liquid crystal cells are alternately arranged between every two horizontally adjacent data lines along the data lines, so as to reduce power consumption resulting from the polarity inversion of an image signal.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device having a plurality of liquid crystal cells formed respectively in pixel areas defined by intersections of n gate lines and m data lines, wherein each of the liquid crystal cells comprises:

a thin film transistor connected to an adjacent one of the gate lines and an adjacent one of the data lines; and a liquid crystal capacitor and a storage capacitor between an adjacent another data line and the thin film transistor, wherein the liquid crystal capacitor and the storage capacitor connect with the adjacent data line through the thin film transistor and wherein the liquid crystal capacitor and the storage capacitor share an electrode that directly connects with the adjacent another data line, wherein the liquid crystal cells are arranged on a plurality of horizontal lines corresponding respectively to the gate lines, wherein odd and even liquid crystal cells on each of the horizontal lines are simultaneously driven by the driving of a corresponding one of the gate lines, and wherein two data lines driving one of the odd liquid crystal cells on the each horizontal line are separated from two adjacent another data lines driving an adjacent one of the even liquid crystal cells.

2. The liquid crystal display device according to claim 1, wherein the thin film transistor of each of the liquid crystal cells is connected to a corresponding one of the gate lines and a corresponding odd one of the data lines.

3. The liquid crystal display device according to claim 2, wherein the thin film transistors of the liquid crystal cells are alternately arranged between every two horizontally adjacent ones of the data lines along the data lines.

4. The liquid crystal display device according to claim 1, wherein the liquid crystal cells are arranged on a plurality of horizontal lines corresponding respectively to the gate lines, wherein each of the horizontal lines comprises:

a first liquid crystal cell group including the thin film transistors connected to a corresponding one of the gate lines and a (4j−3)th (where j is a natural number which is m/4) one of the data lines; and a second liquid crystal cell group including the thin film transistors connected to the corresponding gate line and a (4j)th one of the data lines.

5. The liquid crystal display device according to claim 1, wherein the liquid crystal cells are arranged on a plurality of horizontal lines corresponding respectively to the gate lines, wherein each of the horizontal lines comprises:

a first liquid crystal cell group including the thin film transistors connected to a corresponding one of the gate lines and a (4j−2)th (where j is a natural number which is m/4) one of the data lines; and a second liquid crystal cell group including the thin film transistors connected to the corresponding gate line and a (4j−1)th one of the data lines.

6. The liquid crystal display device according to claim 1, wherein the liquid crystal cells are arranged on a plurality of horizontal lines corresponding respectively to the gate lines, wherein the horizontal lines comprise:

odd horizontal lines comprising a first liquid crystal cell group including the thin film transistors each connected to a corresponding odd one of the gate lines and a (4j−3)th (where j is a natural number which is m/4) one of the data lines, and a second liquid crystal cell group including the thin film transistors each connected to a corresponding odd one of the gate lines and a (4j)th one of the data lines; and even horizontal lines comprising a third liquid crystal cell group including the thin film transistors each connected to a corresponding even one of the gate lines and a (4j−2)th one of the data lines, and a fourth liquid crystal cell group including the thin film transistors each connected to a corresponding even one of the gate lines and a (4j−1)th one of the data lines.

7. A liquid crystal display device comprising:

an image display panel including a plurality of liquid crystal cells formed respectively in pixel areas defined by intersections of n gate lines and m data lines;

a gate driving circuit for driving the gate lines;

a data driving circuit for converting the same data into first and second image signals, the first and second image signals having voltage levels symmetrical about a middle voltage between a lowest voltage and a highest voltage, and supplying the converted first and second image signals respectively to two adjacent data lines of the data lines; and a timing controller for controlling the gate driving circuit and the data driving circuit and supplying the data corresponding to the first and second image signals to the data driving circuit, wherein the liquid crystal cells are arranged on a plurality of horizontal lines corresponding respectively to the gate lines, each of the liquid crystal cells comprises:

a thin film transistor connected to an adjacent one of the gate lines and an adjacent one of the data lines; and a liquid crystal capacitor and a storage capacitor connected between an adjacent another data line and the thin film transistor, wherein the liquid crystal capacitor and the storage capacitor connect with the adjacent data line through the thin film transistor and wherein the liquid crystal capacitor and the storage capacitor share an electrode that directly connects with the adjacent another data line, wherein odd and even liquid crystal cells on each of the horizontal lines are simultaneously driven by the driving of a corresponding one of the gate lines, and wherein two data lines driving one of the odd liquid crystal cells on the each horizontal line are separated from two adjacent another data lines driving adjacent one of the even liquid crystal cells.

8. The liquid crystal display device according to claim 7, wherein the timing controller comprises a data arranger for arranging input data signals and supplying the arranged data signals to the data driving circuit, wherein the data arranger comprises:

a data storage unit for storing the input data signals;

a double data generator for doubling each of the data signals stored in the data storage unit into two data for generation of the first and second image signals; and a data output unit for arranging the two data to be supplied to each of the liquid crystal cells, outputted from the double data generator, and supplying the arranged data to the data driving circuit.

9. The liquid crystal display device according to claim 8, wherein each of the liquid crystal cells further comprises:

a pixel electrode connected to the thin film transistor; and an opposite electrode connected to the adjacent another data line, the opposite electrode being the electrode shared by the liquid crystal capacitor and the storage capacitor, wherein the liquid crystal capacitor is formed by a liquid crystal layer between the pixel electrode and the opposite electrode; and the storage capacitor is formed by an overlap of the pixel electrode and the opposite electrode.

10. The liquid crystal display device according to claim 9, wherein the thin film transistor of each of the liquid crystal cells is connected to a corresponding one of the gate lines and a corresponding odd one of the data lines.

11. The liquid crystal display device according to claim 10, wherein the thin film transistors of the liquid crystal cells are alternately arranged between every two horizontally adjacent ones of the data lines along the data lines.

12. The liquid crystal display device according to claim 9, wherein the image display panel includes the plurality of horizontal lines corresponding respectively to the gate lines, wherein each of the horizontal lines comprises:

a first liquid crystal cell group including the thin film transistors connected to a corresponding one of the gate lines and a (4j−3)th (where j is a natural number which is m/4) one of the data lines; and a second liquid crystal cell group including the thin film transistors connected to the corresponding gate line and a (4j)th one of the data lines.

13. The liquid crystal display device according to claim 9, wherein the image display panel includes the plurality of horizontal lines corresponding respectively to the gate lines, wherein each of the horizontal lines comprises:

a first liquid crystal cell group including the thin film transistors connected to a corresponding one of the gate lines and a (4j−2)th (where j is a natural number which is m/4) one of the data lines; and a second liquid crystal cell group including the thin film transistors connected to the corresponding gate line and a (4j−1)th one of the data lines.

14. The liquid crystal display device according to claim 9, wherein the image display panel includes the plurality of horizontal lines corresponding respectively to the gate lines, wherein the horizontal lines comprise:

odd horizontal lines comprising a first liquid crystal cell group including the thin film transistors each connected to a corresponding odd one of the gate lines and a (4j−3)th (where j is a natural number which is m/4) one of the data lines, and a second liquid crystal cell group including the thin film transistors each connected to a corresponding odd one of the gate lines and a (4j)th one of the data lines; and even horizontal lines comprising a third liquid crystal cell group including the thin film transistors each connected to a corresponding even one of the gate lines and a (4j−2)th one of the data lines, and a fourth liquid crystal cell group including the thin film transistors each connected to a corresponding even one of the gate lines and a (4j−1)th one of the data lines.

15. The liquid crystal display device according to claim 8, wherein the data driving circuit samples the data supplied from the data arranger, and converts the sampled data into any one of the first and second image signals having a voltage level higher than the middle voltage and the other one of the first and second image signals having a voltage level lower than the middle voltage in response to a polarity control signal.

16. A method for driving a liquid crystal display device, the liquid crystal display device having a plurality of liquid crystal cells formed respectively in pixel areas defined by intersections of n gate lines and m data lines, the method comprising:

sequentially driving the gate lines;

converting the same data into first and second image signals, the first and second image signals being symmetrical about a middle voltage between a lowest voltage and a highest voltage;

supplying the first and second image signals to each of the liquid crystal cells, respectively, through two adjacent data lines of the data lines; and simultaneously driving odd and even liquid crystal cells arranged on each of horizontal lines by the driving of a corresponding one of the gate lines using the first and second image signals supplied to each of the liquid crystal cells, wherein each of the liquid crystal cells comprises:

a thin film transistor connected to an adjacent one of the gate lines and an adjacent one of the data lines; and a liquid crystal capacitor and a storage capacitor connected between an adjacent another data line and the thin film transistor, wherein the liquid crystal capacitor and the storage capacitor connect with the adjacent data line through the thin film transistor and wherein the liquid crystal capacitor and the storage capacitor share an electrode that directly connects with the adjacent another data line, wherein two data lines driving one of the odd liquid crystal cells on the each horizontal line are separated from two adjacent another data lines driving adjacent one of the even liquid crystal cells.

17. The method according to claim 16, wherein the step of converting comprises:

generating a plurality of positive gamma voltages having different voltage levels higher than the middle voltage and a plurality of negative gamma voltages having different voltage levels lower than the middle voltage, the negative gamma voltages being symmetrical to the positive gamma voltages with respect to the middle voltage;

sampling the data; and converting the sampled data into the first and second image signals in response to a polarity control signal using the positive gamma voltages and the negative gamma voltages.

18. The method according to claim 16, wherein the step of supplying comprises supplying the first image signal to each odd one of the data lines and, at the same time, the second image signal to each even one of the data lines synchronously with the driving of each of the gate lines.

19. The method according to claim 18, wherein the step of driving comprises driving each of the liquid crystal cells using a potential difference of the first image signal supplied to a corresponding one of the odd data lines from the second image signal supplied to a corresponding one of the even data lines as a reference voltage.

20. The method according to claim 18, wherein the step of driving comprises:

driving each of the liquid crystal cells on each odd horizontal line using a potential difference of the first image signal supplied to a corresponding one of the odd data lines from the second image signal supplied to a corresponding one of the even data lines as a reference voltage; and driving each of the liquid crystal cells on each even horizontal line using a potential difference of the second image signal supplied to a corresponding one of the even data lines from the first image signal supplied to a corresponding one of the odd data lines as a reference voltage.

21. The method according to claim 18, wherein the step of driving comprises:

driving each odd one of the liquid crystal cells on each horizontal line using a potential difference of the first image signal supplied to a (4j−3)th one of the data lines from the second image signal supplied to a (4j−2)th (where j is a natural number which is m/4) one of the data lines as a reference voltage; and driving each even one of the liquid crystal cells on each horizontal line using a potential difference of the second image signal supplied to a (4j)th one of the data lines from the first image signal supplied to a (4j−1)th one of the data lines as a reference voltage.

22. The method according to claim 18, wherein the step of driving comprises:

driving each odd one of the liquid crystal cells on each horizontal line using a potential difference of the second image signal supplied to a (4j−2)th one of the data lines from the first image signal supplied to a (4j−3)th (where j is a natural number which is m/4) one of the data lines as a reference voltage; and driving each even one of the liquid crystal cells on each horizontal line using a potential difference of the first image signal supplied to a (4j−1)th one of the data lines from the second image signal supplied to a (4j)th one of the data lines as a reference voltage.

23. The method according to claim 18, wherein the step of driving comprises:

driving each odd one of the liquid crystal cells on each odd horizontal line using a potential difference of the first image signal supplied to a (4j−3)th one of the data lines from the second image signal supplied to a (4j−2)th (where j is a natural number which is m/4) one of the data lines as a reference voltage;

driving each even one of the liquid crystal cells on each odd horizontal line using a potential difference of the second image signal supplied to a (4j)th one of the data lines from the first image signal supplied to a (4j−1)th one of the data lines as a reference voltage;

driving each odd one of the liquid crystal cells on each even horizontal line using a potential difference of the second image signal supplied to the (4j−2)th data line from the first image signal supplied to the (4j−3)th data line as a reference voltage; and driving each even one of the liquid crystal cells on each even horizontal line using a potential difference of the first image signal supplied to the (4j−1)th data line from the second image signal supplied to the (4j)th data line as a reference voltage.

24. The liquid crystal display device according to claim 1, wherein the electrode shared by the liquid crystal cell capacitor and the storage capacitor directly connects with the adjacent another data line via a contact hole.

25. The liquid crystal display device according to claim 7, wherein the electrode shared by the liquid crystal cell capacitor and the storage capacitor directly connects with the adjacent another data line via a contact hole.

26. The method according to claim 16, wherein the electrode shared by the liquid crystal cell capacitor and the storage capacitor directly connects with the adjacent another data line via a contact hole.

* * * * *